US007319453B2

(12) United States Patent
Nojiri et al.

(10) Patent No.: US 7,319,453 B2
(45) Date of Patent: Jan. 15, 2008

(54) IMAGE DISPLAY APPARATUS HAVING PLURALITY OF PIXELS ARRANGED IN ROWS AND COLUMNS

(75) Inventors: Isao Nojiri, Hyogo (JP); Hiroyuki Murai, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 610 days.

(21) Appl. No.: 11/000,241

(22) Filed: Dec. 1, 2004

(65) Prior Publication Data

US 2005/0179677 A1 Aug. 18, 2005

(30) Foreign Application Priority Data

Feb. 17, 2004 (JP) ..... 2004-039988

(51) Int. Cl.
*G09G 3/36* (2006.01)
*G09G 5/10* (2006.01)

(52) U.S. Cl. ..... 345/100; 345/84; 345/87; 345/98; 345/690

(58) Field of Classification Search ..... 345/30, 345/34, 59, 84, 87, 98, 100, 204, 690
See application file for complete search history.

(56) References Cited

U.S. PATENT DOCUMENTS 6,791,539 B2 * 9/2004 Nakajima et al. ..... 345/204
7,079,103 B2 * 7/2006 Morita ..... 345/98
7,133,013 B2 * 11/2006 Kamezaki et al. ..... 345/98
2001/0033278 A1 10/2001 Ohta et al.

FOREIGN PATENT DOCUMENTS

| | | |
|---|---|---|
| CN | 1319830 A | 10/2001 |
| JP | 2001-343928 | 12/2001 |
| JP | 2003-029715 | 1/2003 |

OTHER PUBLICATIONS

Chinese Office Action, with English translation, issued in Chinese Patent Application No. CN 2004101021321, mailed Jun. 22, 2007.

* cited by examiner

*Primary Examiner*—Richard Hjerpe
*Assistant Examiner*—My-Chau T. Tran
(74) *Attorney, Agent, or Firm*—McDermott Will & Emery LLP

(57) ABSTRACT

In a partial display mode, a source IC outputs a start signal at an "H" level designating the start of vertical scanning by a vertical scanning circuit, over a plurality of cycles from before a time T1 to after a time T8. A plurality of shift registers sequentially shift the start signal in synchronization with a clock signal to sequentially drive a plurality of activation enable signals, respectively, to an "H" level. Then, after time T8 when first to fourth activation enable signals simultaneously attain an "H" level, the source IC outputs an enabling signal at an "H" level to the vertical scanning circuit. In response, the vertical scanning circuit simultaneously activates first to fourth gate lines corresponding to the first to the fourth activation enable signals, respectively.

9 Claims, 15 Drawing Sheets

14

14A

14B

IMAGE DISPLAY APPARATUS HAVING PLURALITY OF PIXELS ARRANGED IN ROWS AND COLUMNS

BACKGROUND OF THE INVENTION

1. Field of the Invention

The present invention relates to an image display apparatus, and in particular, an image display apparatus in which a plurality of pixels arranged in rows and columns in an image display portion are driven to display an image.

2. Description of the Background Art

Liquid crystal display apparatuses have been used widely in portable equipment such as cellular phones, as display devices with low power consumption. A liquid crystal display apparatus generally includes an image display portion having a plurality of pixels arranged in rows and columns, a horizontal scanning circuit applying a display voltage corresponding to display data to a plurality of source lines provided in the column direction corresponding to the pixels, and a vertical scanning circuit activating a plurality of gate lines provided in the row direction corresponding to the pixels. Gate lines are sequentially activated by the vertical scanning circuit, and the display voltage corresponding to the display data is supplied to the pixels connected to a row to be scanned, by the horizontal scanning circuit via the source lines. Consequently, a liquid crystal cell included in each pixel emits light with a display luminance corresponding to the supplied display voltage, and a desired image is displayed all over the image display portion.

In the portable equipment, a partial display function is known, in which an image is displayed only in a partial region of the image display portion and it is not displayed in the remaining region in a standby mode, to achieve even lower power consumption. With regards to this partial display function, a specific color (for example white or black) is generally displayed in a non-display region. There has been a problem that the horizontal and vertical scanning circuits operate also in the non-display region to display the specific color as in the display region, thus failing to reduce power consumption sufficiently.

In relation to such a problem, Japanese Patent Laying-Open No. 2001-343928 discloses an image display circuit for an image display apparatus equipped with a partial display function. The image display circuit includes an output control block controlling an output of an ON signal to each scanning signal line (equivalent to a gate line), such that scanning signals for display are output at one time to a plurality of scanning signal lines corresponding to a non-display region in response to a gate control signal for making a transition as for the output of the ON signal to each scanning signal line from sequential output to simultaneous output.

According to the image display apparatus, since a specific color is displayed in the non-display region simultaneously in the partial display function, a period during which an operation of a scanning signal line driving section is suppressed can be achieved after the simultaneous display, reducing power consumption of the scanning signal line driving section during the period.

Further, the so-called self-refresh function is known in the portable equipment to achieve lower power consumption as in the partial display function. By the self-refresh function, display data (a display voltage) is temporarily saved in each pixel and the saved data is used to rewrite the display data in a refresh operation, without supplying the display voltage corresponding to the display data from a horizontal scanning circuit.

It is possible for the self-refresh function to perform data rewrite simultaneously for all pixels in an image display portion, however, such a data rewrite simultaneously performed for all the pixels requires a driver large enough to drive all the pixels. Furthermore, the interconnection should be thicker to prevent malfunction due to noise caused by the simultaneous driving, resulting in an increase in the size of the apparatus.

For the above problem, a partial self-refresh function is known, which partially performs the self-refresh function for each block of an image display portion divided into blocks. In the partial self-refresh function, the image display portion is divided into blocks for a plurality of gate lines, for example. According to the partial self-refresh function, the number of pixels to be rewritten simultaneously is limited by the size of the block, causing no problems concerning the size of a driver and the size of an interconnection in the case where the self-refresh operation is simultaneously performed for all the pixels.

In both of the partial display function disclosed in Japanese Patent Laying-Open No. 2001-343928 and the conventional partial self-refresh function described above, it is necessary to simultaneously control some of a plurality of pixel control lines. That is, in the partial display function disclosed in Japanese Patent Laying-Open No. 2001-343928, a plurality of gate lines corresponding to the non-display region must be activated simultaneously, and in the conventional partial self-refresh function described above, a plurality of gate lines corresponding to a block to be refreshed must be activated simultaneously.

In the image display apparatus disclosed in Japanese Patent Laying-Open No. 2001-343928 described above, however, the output control block is additionally provided to implement the partial display function, causing an increase in the area of the apparatus.

In addition, in the conventional partial self-refresh function described above, a plurality of control signal lines and a plurality of buffer circuits corresponding to the control signal lines are additionally required to implement the function, rendering the control circuit complicated.

SUMMARY OF THE INVENTION

The present invention is thus made to solve the above problems, and an object of the invention is to provide an image display apparatus readily capable of simultaneously controlling a part of a plurality of pixel control lines.

According to the present invention, the image display apparatus includes an image display portion including a plurality of image display elements arranged in rows and columns; a plurality of pixel control lines arranged corresponding to the rows of the plurality of image display elements; a vertical scanning circuit connected to the plurality of pixel control lines; and a control device generating a scanning start signal for designating start of vertical scanning and an enabling signal for designating activation of a pixel control line of activation target, and outputting each of the generated signals to the vertical scanning circuit. In a partial display mode partially displaying an image on the image display portion, or in a partial self-refresh operation dividing a self-refresh operation for saving and rewriting data in the plurality of image display elements into a plurality of blocks and performing the self-refresh operation for each block in the image display portion, the vertical scanning circuit simultaneously places multiple pixel control lines corresponding in number to an activation period of the scanning start signal at an activation enable state, and simultaneously activates the multiple pixel control lines in the activation enable state in response to activation of the enabling signal, with a region corresponding to the multiple pixel control lines in the activation enable state as a non-display region or a refresh region.

In the image display apparatus according to the present invention, the scanning start signal designating the start of vertical scanning is variable. In the partial display mode or in the partial self-refresh operation, multiple pixel control lines corresponding in number to the activation period of the scanning start signal are simultaneously activated.

Therefore, according to the present invention, the plurality of pixel control lines can readily be controlled simultaneously with no addition of a new circuit. As a result, the partial display function and the partial self-refresh function can be implemented with a simple structure.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
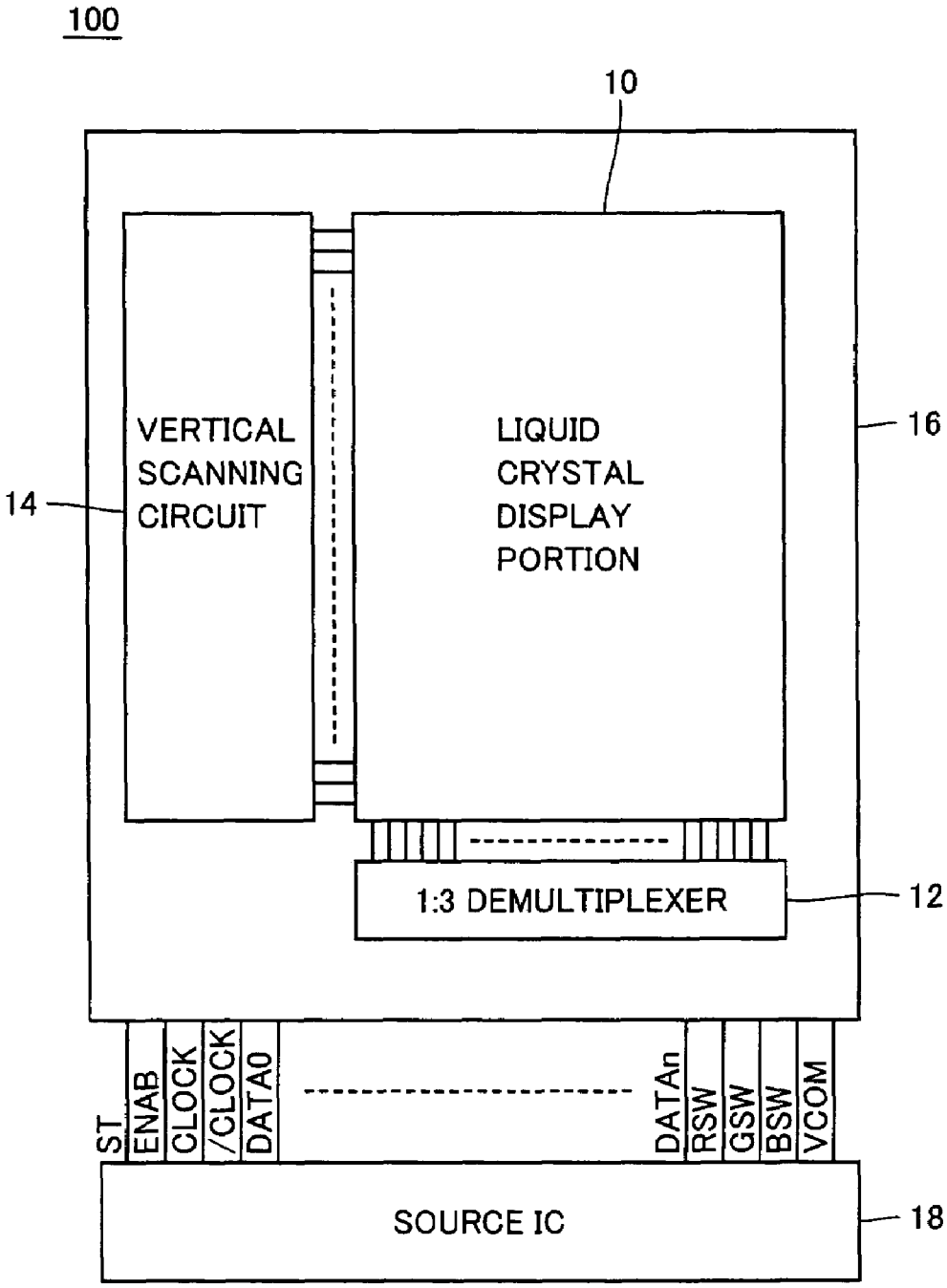
FIG. 1 is a schematic block diagram showing an overall structure of a liquid crystal display apparatus in accordance with a first embodiment of the present invention.

In the following, embodiments of the present invention will be described in detail with reference to the accompanying drawings, in which identical or corresponding parts will be designated by the same reference numerals, and the description thereof will not be repeated.

First Embodiment

In a first embodiment, there is shown a liquid crystal display apparatus having a partial display function during a standby mode.

FIG. 1 is a schematic block diagram showing an overall structure of a liquid crystal display apparatus 100 in accordance with the first embodiment of the present invention. Referring to FIG. 1, liquid crystal display apparatus 100 includes a liquid crystal display portion 10, a 1:3 demultiplexer 12, a vertical scanning circuit 14, a substrate 16, and a source IC 18.

Liquid crystal display portion 10 includes a plurality of pixels arranged in rows and columns (not shown). Each pixel is provided with a color filter in either one of three primary colors, that is, R (red), G (green), and B (blue). A pixel (R), a pixel (G), and a pixel (B) adjacent in a column direction form one display unit. Furthermore, a plurality of gate lines are arranged corresponding to the rows of the pixels, and a plurality of source lines are arranged corresponding to the columns of the pixels.

1:3 demultiplexer 12 receives from source IC 18 display voltages DATA0-DATAn corresponding to display data, and supplies the received display voltages to corresponding source lines. More specifically, 1:3 demultiplexer 12 receives from source IC 18 display voltage DATAi (i is an integer of 0-n) corresponding to pixel (R), pixel (G), and pixel (B) and serially output from source IC 18 for each display unit of a selected gate line. Then, 1:3 demultiplexer 12 outputs the received display voltage DATAi in time division to source lines respectively corresponding to pixel (R), pixel (G), and pixel (B) of each display unit.

Vertical scanning circuit 14 receives a start signal ST, an enabling signal ENAB, and clock signals CLOCK and /CLOCK from source IC 18, and activates the plurality of gate lines arranged in the row direction at predetermined timing in response to these signals. More specifically, in a normal operation, vertical scanning circuit 14 is induced by the activation of start signal ST to sequentially activate the plurality of gate lines in synchronization with clock signals CLOCK and /CLOCK. On the other hand, in a partial display mode which will be described later, vertical scanning circuit 14 sequentially activates, in a display region of liquid crystal display portion 10, gate lines corresponding to the display region in synchronization with clock signals CLOCK and /CLOCK, as in the normal operation. In a non-display region of liquid crystal display portion 10, however, vertical scanning circuit 14 simultaneously activates gate lines corresponding to the non-display region when receiving enabling signal ENAB from source IC 18.

Source IC 18 generates start signal ST, enabling signal ENAB, and clock signals CLOCK and /CLOCK for output to vertical scanning circuit 14. Start signal ST is a signal for designating start of scanning of a gate line by vertical scanning circuit 14, and it is activated at the beginning of a frame. Enabling signal ENAB is a signal for providing activation timing for a gate line set to an activation enable state by vertical scanning circuit 14.

Further, source IC 18 generates display voltages DATA0-DATAn respectively corresponding to display units connected to the gate line selected by vertical scanning circuit 14, and outputs the generated display voltages DATA0-DATAn to 1:3 demultiplexer 12. Source IC 18 also outputs to 1:3 demultiplexer 12 switching signals RSW, GSW, and BSW for subjecting each of display voltages DATA0-DATAn to time division for each pixel. Switching signals RSW, GSW, and BSW are signals for selecting the respective source lines corresponding to pixel (R), pixel (G), and pixel (B) of each display unit. Furthermore, source IC 18 outputs a counter electrode voltage VCOM to liquid crystal display portion 10.

It is to be noted that liquid crystal display portion 10 constitutes an "image display portion", and source IC 18 constitutes a "control device".

Figure 2:
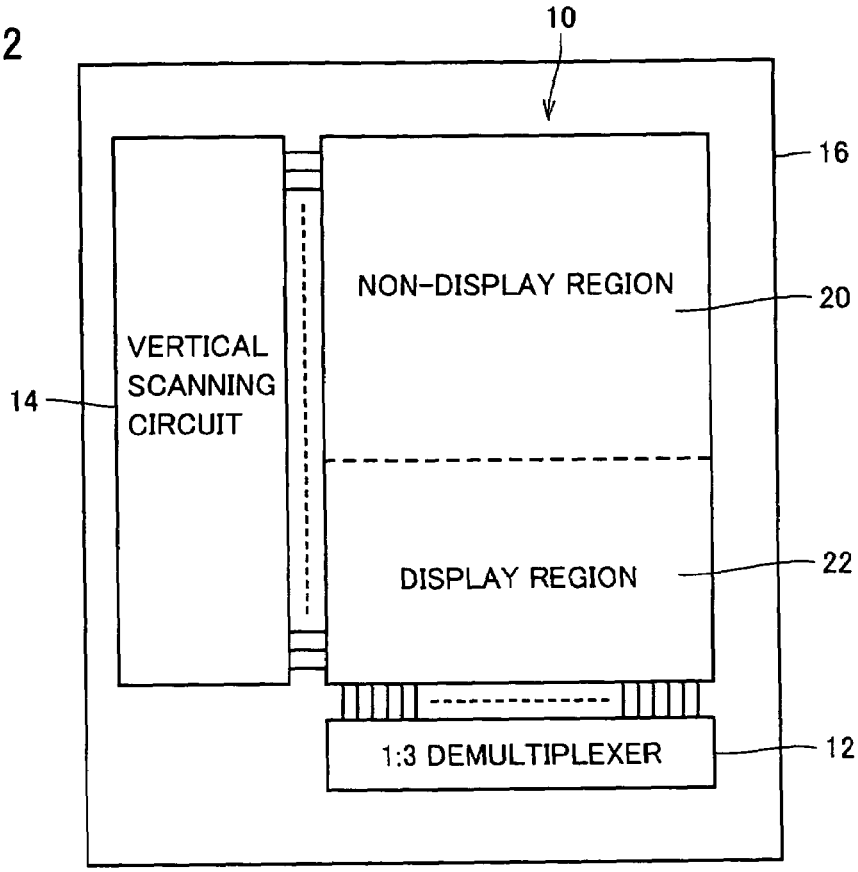
FIG. 2 shows a display status in a partial display mode of the liquid crystal display apparatus shown in FIG. 1.

FIG. 2 shows a display status in the partial display mode of liquid crystal display apparatus 100 shown in FIG. 1. Referring to FIG. 2, liquid crystal display apparatus 100 makes a transition to the "partial display mode" during standby, in which an image is displayed only in a partial region 22 and not displayed in the remaining region 20. Actually, in the partial display mode, a specific color (for example white or black) is displayed in region 20.

Figure 3:
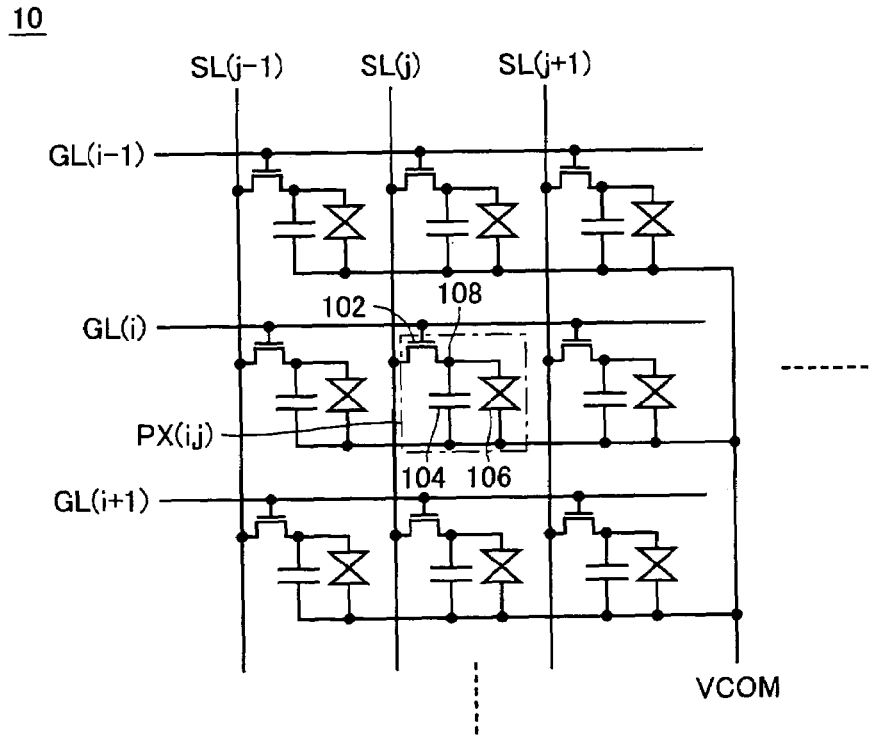
FIG. 3 is a circuit diagram showing a structure of a liquid crystal display portion shown in FIG. 1.

FIG. 3 is a circuit diagram showing a structure of liquid crystal display portion 10 shown in FIG. 1. It is to be noted that, for illustration purpose, FIG. 3 shows only a part of liquid crystal display portion 10. Referring to FIG. 3, liquid crystal display portion 10 includes a plurality of pixels PXs, a plurality of gate lines GLs, and a plurality of source lines SLs. Each of the plurality of pixels PXs includes an N-channel thin film transistor 102, a capacitor 104, and a liquid crystal display element 106. Hereinafter, the thin film transistor will also be referred to as "TFT".

The plurality of pixels PXs are arranged in rows and columns. The plurality of gate lines GLs are arranged along the rows. The plurality of source lines SLs are arranged along the columns. Each of the plurality of pixels PXs is connected to corresponding source line SL and gate line GL. Further, each of the plurality of pixels PXs receives counter electrode voltage VCOM in common.

In a pixel PX(i, j), N-channel TFT 102 is connected between a node 108 and a source line SL(j) connected to source IC 18 (not shown), and its gate is connected to a gate line GL(i) connected to vertical scanning circuit 14 (not shown). Liquid crystal display element 106 has a pixel electrode connected to node 108, and a counter electrode to which counter electrode voltage VCOM is applied. One end of capacitor 104 is connected to node 108, and the other end is fixed to counter electrode voltage VCOM.

In pixel PX(i, j), the orientation of liquid crystal in liquid crystal display element 106 varies depending on the potential difference between the pixel electrode and the counter electrode, causing a change in the luminance (reflectance) of liquid crystal display element 106. Thus, liquid crystal display element 106 attains the luminance (reflectance) in accordance with the display voltage applied from source IC 18 through source line SL(j) and N-channel TFT 102.

Gate line GL(i) is activated by vertical scanning circuit 14, and the display voltage is applied from source line SL(i) to liquid crystal display element 106. Thereafter, gate line GL(i) is inactivated, and N-channel TFT 102 is turned OFF. However, since capacitor 104 keeps the potential of the pixel electrode even during the OFF period of N-channel TFT 102, liquid crystal display element 106 can maintain the luminance (reflectance) in accordance with the applied display voltage.

Since other pixels PXs also have the same structure, the description thereof will not be repeated. Further, the plurality of gate lines GLs constitute "a plurality of pixel control lines".

Figure 4:
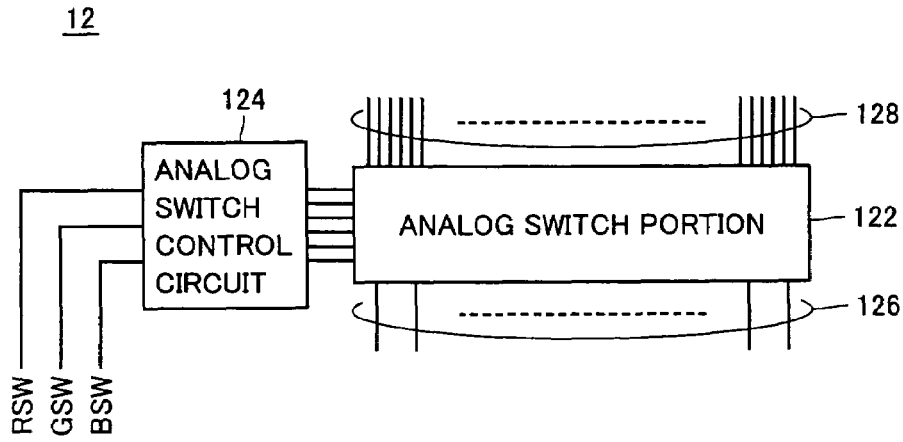
FIG. 4 is a functional block diagram showing a structure of a 1:3 demultiplexer shown in FIG. 1.

FIG. 4 is a functional block diagram showing a structure of 1:3 demultiplexer 12 shown in FIG. 1. Referring to FIG. 4, 1:3 demultiplexer 12 includes an analog switch portion 122 and an analog switch control circuit 124.

Analog switch portion 122 receives the display voltages for each display unit from source IC 18 (not shown) through external source lines 126. As described above, the display voltages corresponding to the respective pixels of each display unit are serially output from source IC 18. Analog switch portion 122 then receives switching switching signals RSW, GSW, BSW and their respective complementary signals /RSW, /GSW, /BSW from analog switch control circuit 124, and subjects the display voltages for the respective pixels of each display unit to time division in response to these signals, for sequential output to source lines 128.

Analog switch control circuit 124 receives switching signals RSW, GSW, and BSW from source IC 18, and outputs the received switching signals RSW, GSW, BSW and their respective complementary signals /RSW, /GSW, /BSW to analog switch portion 122.

Figure 5:
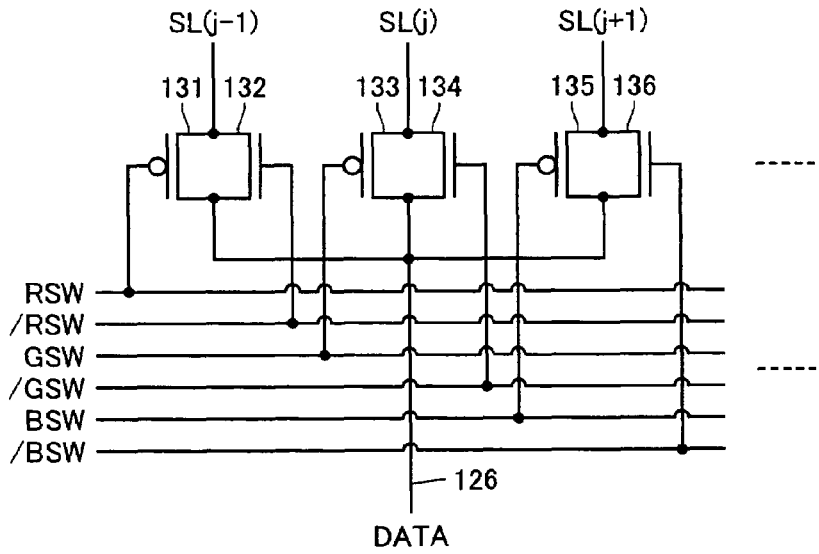
FIG. 5 is a circuit diagram showing a structure of an analog switch portion shown in FIG. 4.

FIG. 5 is a circuit diagram showing a structure of analog switch portion 122 shown in FIG. 4. It is to be noted that, for illustration purpose, FIG. 5 shows only a part of analog switch portion 122. Referring to FIG. 5, analog switch portion 122 includes P-channel MOS transistors 131, 133, 135 and N-channel MOS transistors 132, 134, 136.

P-channel MOS transistor 131 and N-channel MOS transistor 132 are connected between a source line SL(j−1) and external source line 126, and their gates receive switching signals RSW and /RSW, respectively. P-channel MOS transistor 133 and N-channel MOS transistor 134 are connected between source line SL(j) and external source line 126, and their gates receive switching signals GSW and /GSW, respectively. P-channel MOS transistor 135 and N-channel MOS transistor 136 are connected between a source line SL(j+1) and external source line 126, and their gates receive switching signals BSW and /BSW, respectively.

In analog switch portion 122, when the display voltage for displaying red is supplied to external source line 126 by source IC 18 (not shown) and switching signal RSW is activated, P-channel MOS transistor 131 and N-channel MOS transistor 132, constituting a transfer gate for source line SL(j−1) to which the pixel for displaying red is connected, are turned ON. Accordingly, the display voltage for displaying red is supplied from external source line 126 to source line SL(j−1).

Next, when the display voltage for displaying green is supplied to external source line 126 by source IC 18 and switching signal GSW is activated, P-channel MOS transistor 133 and N-channel MOS transistor 134, constituting a transfer gate for source line SL(j) to which the pixel for displaying green is connected, are turned ON. Accordingly, the display voltage for displaying green is supplied from external source line 126 to source line SL(j).

Next, when the display voltage for displaying blue is supplied to external source line 126 by source IC 18 and switching signal BSW is activated, P-channel MOS transistor 135 and N-channel MOS transistor 136, constituting a transfer gate for source line SL(j+1) to which the pixel for displaying blue is connected, are turned ON. Accordingly, the display voltage for displaying blue is supplied from external source line 126 to source line SL(j+1).

Figure 6:
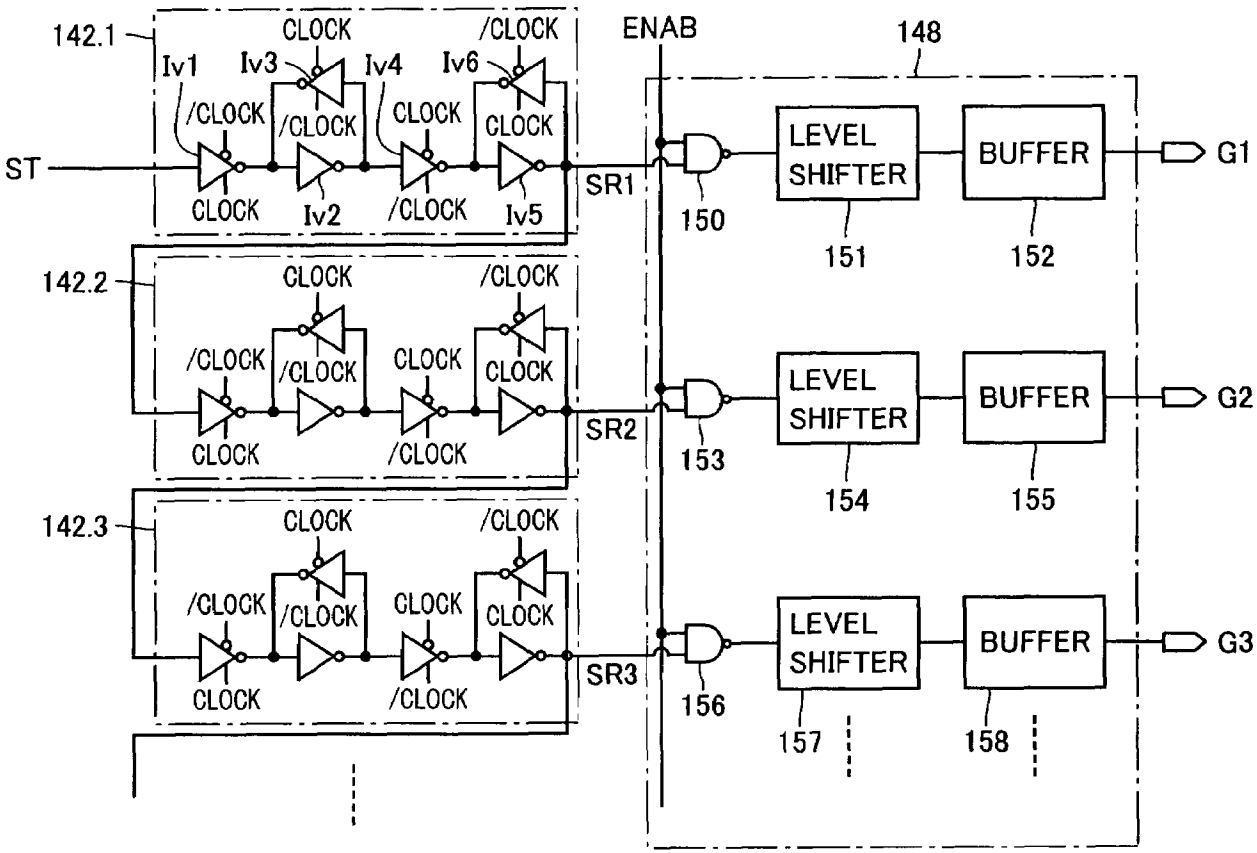
FIG. 6 is a circuit diagram showing a structure of a vertical scanning circuit shown in FIG. 1.

FIG. 6 is a circuit diagram showing a structure of vertical scanning circuit 14 shown in FIG. 1. It is to be noted that, for illustration purpose, FIG. 6 shows only a part of vertical scanning circuit 14. Referring to FIG. 6, vertical scanning circuit 14 includes shift registers 142.1, 142.2, 142.3, . . . and an output control circuit 148. Each of shift registers 142.1, 142.2, 142.3, . . . includes inverters Iv1-Iv6. Output control circuit 148 includes NAND gates 150, 153, 156, level shifters 151, 154, 157, and output buffers 152, 155, 158.

Shift registers 142.1, 142.2, 142.3, . . . are connected in series, and operate in synchronization with clock signals CLOCK and /CLOCK supplied from source IC 18 (not shown). In shift register 142.1, inverter Iv1 receives start signal ST from source IC 18, and outputs an inverted signal of start signal ST in synchronization with the rising timing of clock signal CLOCK. Inverter Iv2 receives the signal output from inverter Iv1, and outputs an inverted signal of the received signal. Inverters Iv3 and Iv4 receive the signal output from inverter Iv2, and outputs an inverted signal of the received signal in synchronization with the falling timing of clock signal CLOCK. Inverter Iv5 receives the signal output from inverter Iv4, and outputs an inverted signal of the received signal as an activation enable signal SR1. Inverter Iv6 receives the signal output from inverter Iv5, and outputs an inverted signal of the received signal in synchronization with the rising timing of clock signal CLOCK.

Shift registers 142.2 and 142.3 have the same circuit configuration as that of shift register 142.1, except that inverter Iv1 receives the signal output from the shift register in the previous stage, instead of start signal ST. Shift registers 142.2 and 142.3 output activation enable signals SR2 and SR3, respectively.

In output control circuit 148, NAND gate 150 carries out an AND operation of activation enable signal SR1 output from shift register 142.1 and enabling signal ENAB output from source IC 18, and outputs an inverted signal of the operation result. Level shifter 151 shifts the signal level of the output signal supplied from NAND gate 150, and output buffer 152 outputs the signal supplied from level shifter 151 to a gate line GL1, as a gate signal G1.

Further, NAND gate 153 carries out an AND operation of activation enable signal SR2 output from shift register 142.2 and enabling signal ENAB, and outputs an inverted signal of the operation result to level shifter 154. Then, output buffer 155 outputs the signal supplied from level shifter 154 to a gate line GL2, as a gate signal G2. NAND gate 156 carries out an AND operation of activation enable signal SR3 output from shift register 142.3 and enabling signal ENAB, and outputs an inverted signal of the operation result to level shifter 157. Then, output buffer 158 outputs the signal supplied from level shifter 157 to a gate line GL3, as a gate signal G3.

In vertical scanning circuit 14, shift registers 142.1, 142.2, 142.3, . . . sequentially shift start signal ST supplied from source IC 18, in synchronization with the falling timing of clock signal CLOCK. Then, at the timing when enabling signal ENAB supplied from source IC 18 attains an "H" (logical high) level, output control circuit 148 activates a gate line GL corresponding to an activation enable signal SR which is at an "H" level at that time.

Figure 7:
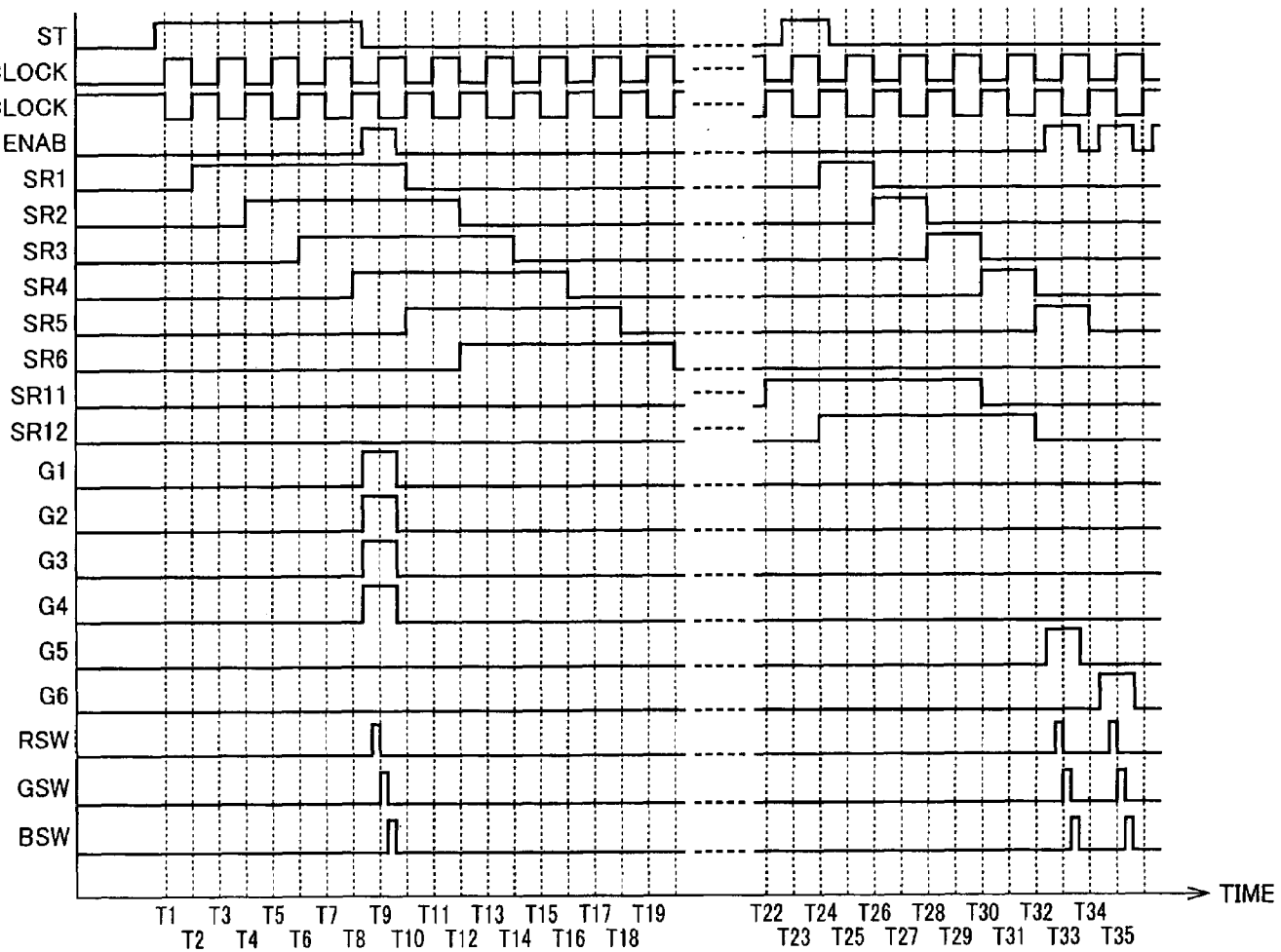
FIG. 7 is an operation waveform diagram of main signals in the liquid crystal display apparatus in accordance with the first embodiment, in the partial display mode.

FIG. 7 is an operation waveform diagram of main signals in liquid crystal display apparatus 100 in accordance with the first embodiment, in the partial display mode. Liquid crystal display apparatus 100 in accordance with the first embodiment carries out frame inversion driving. The polarity of a display voltage applied to a liquid crystal display element is generally inverted from the standpoint of the reliability of liquid crystal. Frame inversion driving switches the polarity of a display voltage for each frame of an image. It is to be noted that, although FIG. 7 shows a case where a region corresponding to the upper four gate lines from a total of 12 gate lines is set as a non-display region, the number of the gate lines is not limited to this.

Referring to FIG. 7, before a time T1, source IC 18 drives start signal ST for output to vertical scanning circuit 14 to an "H" level, and keeps the "H" level until after a time T8, over a plurality of cycles. Shift registers 142.1, 142.2, 142.3, . . . sequentially shift start signal ST in synchronization with clock signals CLOCK and /CLOCK, and sequentially drive activation enable signals SR1, SR2, SR3, . . . to an "H" level at times T2, T4, T6, . . . , respectively.

When activation enable signals SR1-SR4 simultaneously attain the "H" level at time T8, source IC 18 drives enabling signal ENAB for output to vertical scanning circuit 14 to an "H" level. Then, output control circuit 148 of vertical scanning circuit 14 drives gate signals G1-G4 to an "H" level, simultaneously activating gate lines GL1-GL4.

Source IC 18 outputs enabling signal ENAB at the "H" level. Furthermore, source IC 18 also outputs to 1:3 demultiplexer 12 display voltages DATA0-DATAn corresponding to the display in a specific color (for example white or black), and sequentially outputs to 1:3 demultiplexer 12 switching signals RSW, GSW, BSW for subjecting each of display voltages DATA0-DATAn to time division for each pixel.

Thus, the display voltages corresponding to the above-mentioned color display are applied to all the pixels corresponding to gate lines GL1-GL4, constituting the non-display region.

Before a time T23, which is the start timing of the next frame, source IC 18 drives start signal ST to an "H" level again, and this time, source IC 18 drives start signal ST to an "L" (logical low) level immediately after a time T24. Shift registers 142.1, 142.2, 142.3, . . . sequentially shift start signal ST in synchronization with clock signals CLOCK and /CLOCK, and sequentially drive activation enable signals SR1, SR2, SR3, . . . to an "H" level at times T24, T26, T28, . . . , respectively, for only one cycle.

When an activation enable signal SR5 attains an "H" level at a time T32, source IC 18 drives enabling signal ENAB for output to vertical scanning circuit 14 to an "H" level. Accordingly, output control circuit 148 drives a gate signal G5 to an "H" level, activating a gate line GL5. Then, source IC 18 drives enabling signal ENAB to an "H" level for each cycle, sequentially activating the gate lines from and after a gate line GL6 in synchronization with clock signal CLOCK.

Source IC 18 outputs enabling signal ENAB at the "H" level. Furthermore, source IC 18 also outputs to 1:3 demultiplexer 12 display voltages DATA0-DATAn corresponding to the pixels connected to an activated gate line, and sequentially outputs to 1:3 demultiplexer 12 switching signals RSW, GSW, BSW.

Thus, the display voltages corresponding to image data are applied to the pixels corresponding to the gate lines from and after gate line GL5, constituting the display region.

It is to be noted that, in the frame starting at time T23, the polarity of the display voltages is inverted from that in the frame starting at time T1. Also, the polarity may be inverted, not at time T23, but in a cycle starting from the next time T1.

Figure 8:
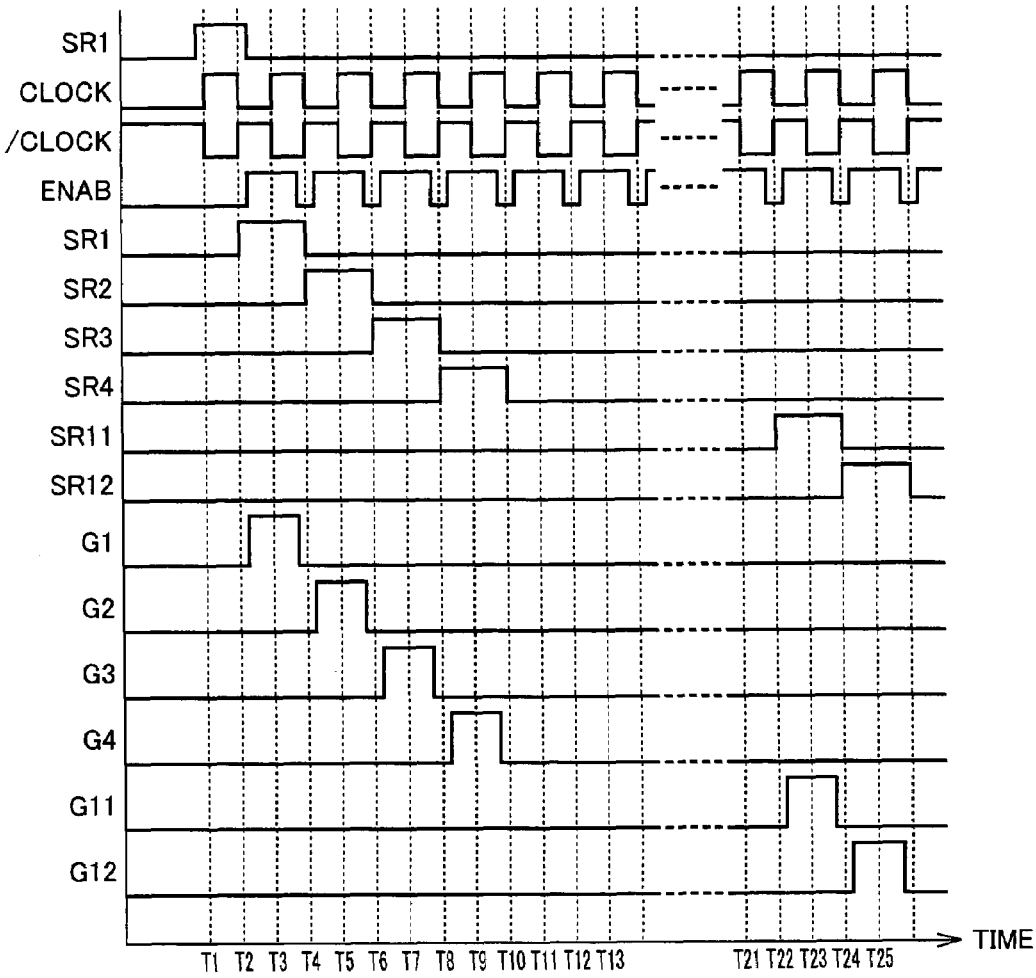
FIG. 8 is an operation waveform diagram of main signals in the liquid crystal display apparatus in accordance with the first embodiment, in a normal operation mode.

FIG. 8 is an operation waveform diagram of main signals in liquid crystal display apparatus 100 in accordance with the first embodiment, in a normal operation mode. Referring to FIG. 8, source IC 18 drives start signal ST to an "H" level before time T1, and to an "L" level after time T2. Shift registers 142.1, 142.2, . . . sequentially shift start signal ST in synchronization with clock signals CLOCK and /CLOCK, and sequentially drive activation enable signals SR1, SR2, . . . to an "H" level at times T2, T4, . . . , respectively, for only one cycle.

Then, at the timing when activation enable signals SR1, SR2, . . . sequentially attain an "H" level, source IC 18 drives enabling signal ENAB to an "H" level on each occasion. Thus, gate signals G1, G2, . . . sequentially attain an "H" level in synchronization with clock signal CLOCK, sequentially activating gate lines GL1, GL2, . . . .

Source IC 18 outputs enabling signal ENAB at the "H" level. Furthermore, source IC 18 also outputs to 1:3 demultiplexer 12 display voltages DATA0-DATAn corresponding to the pixels connected to an activated gate line, and sequentially outputs to 1:3 demultiplexer 12 switching signals RSW, GSW, BSW.

Thus, in liquid crystal display portion 10 shown in FIG. 1, image data is sequentially written to the pixels in the row direction (vertical scanning direction) in synchronization with clock signal CLOCK, and desired image data is displayed all over liquid crystal display portion 10.

In this manner, start signal ST has a variable length in liquid crystal display apparatus 100, and in the partial display mode, setting start signal ST at an "H" level over a plurality of cycles of clock signal CLOCK can provide the non-display region corresponding to that period of time.

In the above description, start signal ST in the partial display mode is kept at the "H" level from time T1 to time T8 in FIG. 7, and a region corresponding to gate lines GL1-GL4 is accordingly set as the non-display region. The non-display region can be enlarged by further extending the period of time during which start signal ST is at the "H" level, and it can be reduced in size by shortening the period of time during which start signal ST is at the "H" level.

Further, in the above description, gate lines GL1-GL4 are simultaneously activated by driving enabling signal ENAB to the "H" level when activation enable signals SR1-SR4 are simultaneously at the "H" level. The non-display region can be set at another part of liquid crystal display portion 10 by changing the timing to drive enabling signal ENAB to the "H" level.

It is to be noted that, in the partial display mode, data corresponding to the display in a specific color is simultaneously written to a plurality of pixels selected by a plurality of gate lines. If time for writing data is insufficient, the cycle of clock signal CLOCK may be prolonged in times T8-T10 in FIG. 7.

As described above, according to liquid crystal display apparatus 100, start signal ST has a variable length, readily allowing for simultaneous control of a plurality of gate lines with no addition of a new circuit. Therefore, the partial display mode can be implemented with a simple structure. Moreover, the ratio between the non-display region and the display region can easily be modified by changing the length of start signal ST, and the position of the non-display region in liquid crystal display portion 10 can be modified arbitrarily by changing the output timing of enabling signal ENAB.

Further, since the display voltages are simultaneously applied to a plurality of pixels corresponding to the non-display region in the partial display mode, source IC 18 and 1:3 demultiplexer 12 operate less number of times, reducing power consumption of liquid crystal display apparatus 100.

It is to be noted that writing data to each pixel in the partial display mode is performed every two frames as shown in FIG. 7. Thus, the cycle for writing data can be shortened by increasing the frequency of clock signal CLOCK during the period in which data writing is not performed (times T1-T8 and T10-T32 in FIG. 7). In this case, however, the period during which source IC 18 and 1:3 demultiplexer 12 do not operate becomes shorter, and thus reduction in power consumption is restrained to some extent.

Second Embodiment

In the first embodiment, a certain time lag occurs in the partial display mode, after writing data in the non-display region until writing data in the display region, as shown in FIG. 7. A second embodiment aims at reducing the time lag for speeding up display operation.

Figure 9:
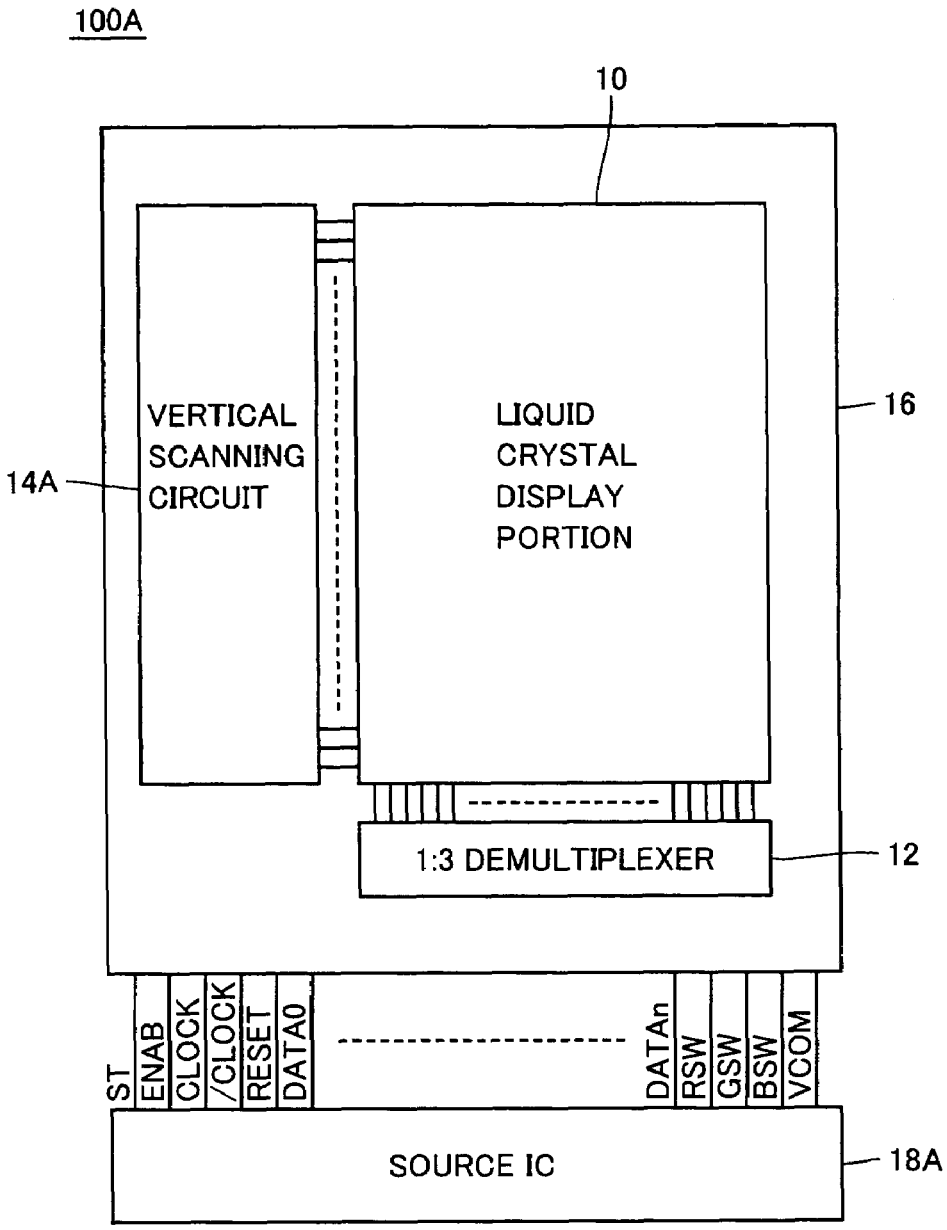
FIG. 9 is a schematic block diagram showing an overall structure of a liquid crystal display apparatus in accordance with a second embodiment of the present invention.

FIG. 9 is a schematic block diagram showing an overall structure of a liquid crystal display apparatus in accordance with the second embodiment of the present invention. Referring to FIG. 9, a liquid crystal display apparatus 100A includes a vertical scanning circuit 14A and a source IC 18A instead of vertical scanning circuit 14 and source IC 18, respectively, in the structure of liquid crystal display apparatus 100 in accordance with the first embodiment shown in FIG. 1.

Vertical scanning circuit 14A is different from vertical scanning circuit 14 in that it further receives a reset signal RESET. Reset signal RESET is a signal for resetting an internal state of vertical scanning circuit 14A. When reset signal RESET attains an "H" level, vertical scanning circuit 14A resets its internal state.

Source IC 18A is different from source IC 18 in that it further outputs reset signal RESET to vertical scanning circuit 14A. As will be described later, in the partial display mode, source IC 18A drives enabling signal ENAB for simultaneously activating the gate lines corresponding to the non-display region to an "H" level, and then drives reset signal RESET to an "H" level.

Figure 10:
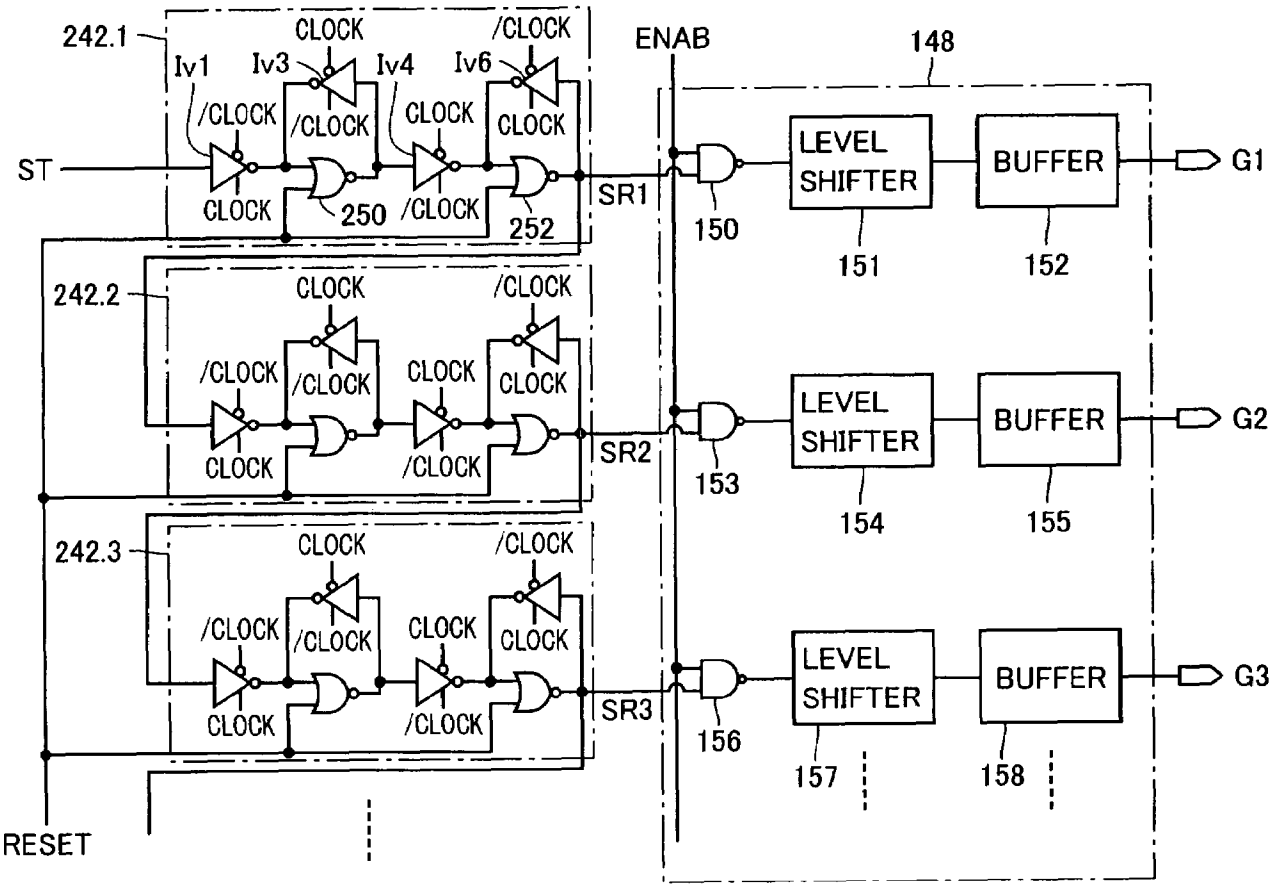
FIG. 10 is a circuit diagram showing a structure of a vertical scanning circuit shown in FIG. 9.

FIG. 10 is a circuit diagram showing a structure of vertical scanning circuit 14A shown in FIG. 9. It is to be noted that, for illustration purpose, FIG. 10 shows only a part of vertical scanning circuit 14A. Referring to FIG. 10, vertical scanning circuit 14A includes shift registers 242.1, 242.2, 242.3, . . . instead of shift registers 142.1, 142.2, 142.3, . . . , in the structure of vertical scanning circuit 14 in accordance with the first embodiment shown in FIG. 6. Each of shift registers 242.1, 242.2, 242.3, . . . includes NOR gates 250 and 252 instead of inverters Iv2 and Iv5, respectively, in the structure of each of shift registers 142.1, 142.2, 142.3, . . . .

NOR gate 250 carries out an OR operation of the output signal of inverter Iv1 and reset signal RESET supplied from source IC 18A (not shown), and outputs an inverted signal of the operation result to inverters Iv3 and Iv4. NOR gate 252 carries out an OR operation of the output signal of inverter Iv4 and reset signal RESET, and outputs an inverted signal of the operation result as activation enable signal SR1.

Since each of shift registers 242.1, 242.2, 242.3, . . . is otherwise structured in the same way as each of shift registers 142.1, 142.2, 142.3 . . . , the description thereof will not be repeated. Further, output control circuit 148 is structured as previously described.

In vertical scanning circuit 14A, when reset signal RESET attains an "H" level, outputs from NOR gates 250 and 252 in each of shift registers 242.1, 242.2, 242.3, . . . attain an "L" level, resetting the internal state of each of shift registers 242.1, 242.2, 242.3, . . . . As a result, all of activation enable signals SR1, SR2, . . . attain an "L" level and are reset.

Figure 11:
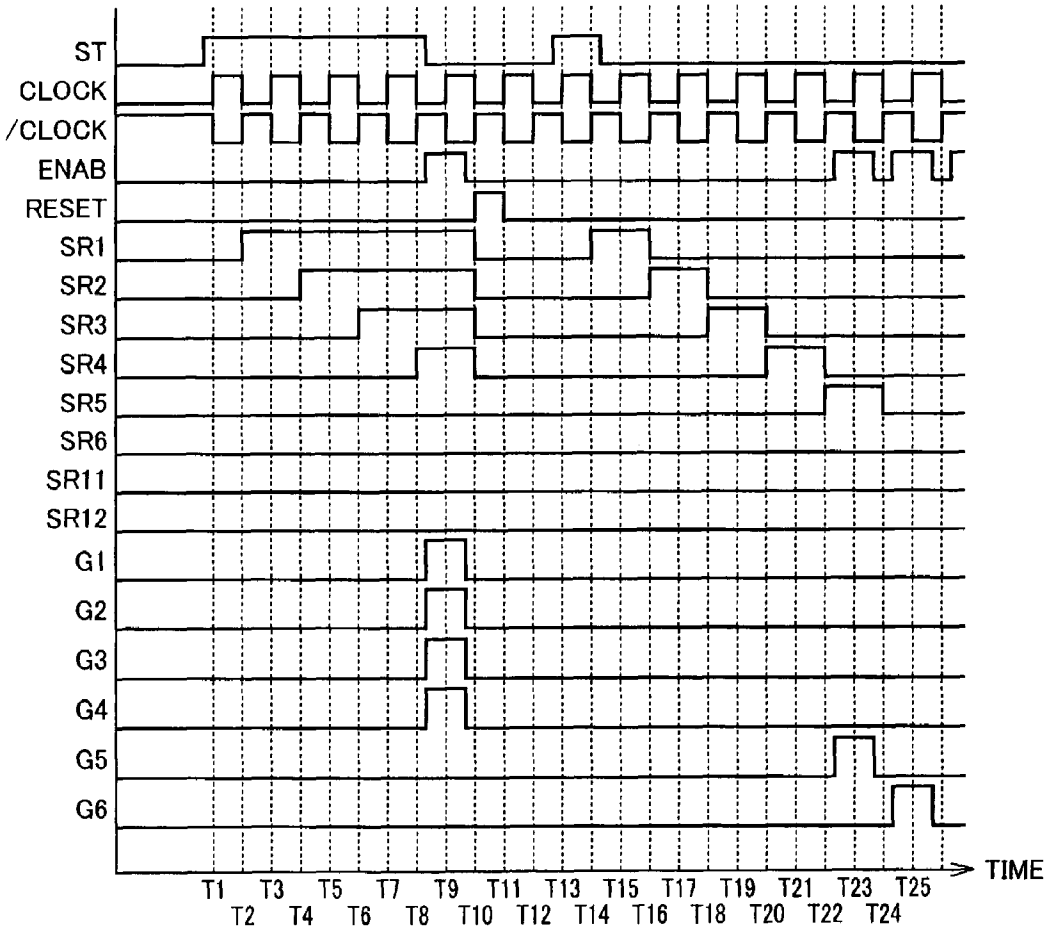
FIG. 11 is an operation waveform diagram of main signals in the liquid crystal display apparatus in accordance with the second embodiment, in a partial display mode.

FIG. 11 is an operation waveform diagram of main signals in liquid crystal display apparatus 100A in accordance with the second embodiment, in the partial display mode. Liquid crystal display apparatus 100A in accordance with the second embodiment also carries out frame inversion driving. It is to be noted that, although FIG. 11 also shows a case where a region corresponding to the upper four gate lines from a total of 12 gate lines is set as a non-display region, the number of the gate lines is not limited to this.

Referring to FIG. 11, from time T1 to time T9, liquid crystal display apparatus 100A carries out the same operation as that of liquid crystal display apparatus 100 in accordance with the first embodiment. Then, when gate lines GL1-GL4 are simultaneously activated, source IC 18A drives reset signal RESET to an "H" level at time T10. This resets the internal state of each of shift registers 242.1, 242.2, 242.3, . . . , and information concerning start signal ST which has been input at time T1 is erased from shift registers 242.1, 242.2, . . . . Activation enable signals SR1-SR4 in shift registers 242.1-242.4, which have been at an "H" level, attain an "L" level.

Thus, an operation for the next frame can immediately be started without waiting for start signal ST, input at time T1 as a signal at an "H" level, to be shifted to the shift register in the last stage and decay.

It is to be noted that, since the operation from and after time T12 is the same as the operation from and after time T22 in liquid crystal display apparatus 100 in accordance with the first embodiment shown in FIG. 7, the description of the operation waveform from and after time T12 will not be repeated.

As described above, according to liquid crystal display apparatus 100A in accordance with the second embodiment, reset signal RESET is provided to reset the internal state of a shift register, reducing the cycle for writing data in the partial display mode. Therefore, display operation in the display region in the partial display mode can be improved.

Third Embodiment

A third embodiment shows a case where liquid crystal display apparatus 100 in the first embodiment carries out line inversion driving. While frame inversion driving switches the polarity of a display voltage for each frame, line inversion driving switches the polarity of a display voltage for each horizontal period (for each gate line).

Since the configuration of a liquid crystal display apparatus in the third embodiment is the same as that of liquid crystal display apparatus 100 in the first embodiment, the description thereof will not be repeated.

Figure 12:
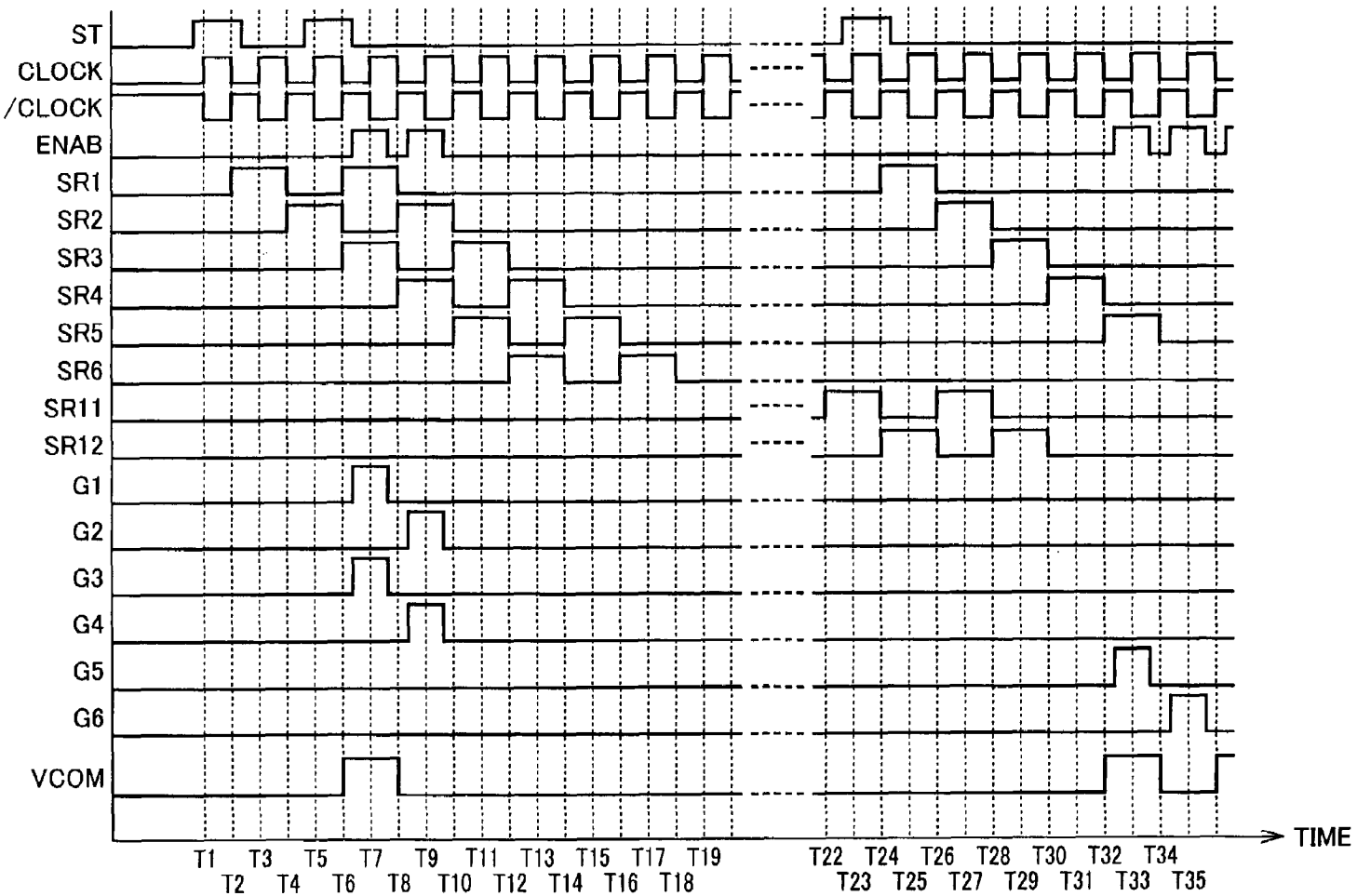
FIG. 12 is an operation waveform diagram of main signals in a liquid crystal display apparatus in accordance with a third embodiment, in a partial display mode.

FIG. 12 is an operation waveform diagram of main signals in the liquid crystal display apparatus in accordance with the third embodiment, in the partial display mode. It is to be noted that, although FIG. 12 also shows a case where a region corresponding to the upper four gate lines from a total of 12 gate lines is set as a non-display region, the number of the gate lines is not limited to this.

Referring to FIG. 12, before time T1, source IC 18 drives start signal ST for output to vertical scanning circuit 14 to an "H" level. After time T2, source IC 18 drives start signal ST to an "L" level. Then, shift registers 142.1, 142.2, 142.3, . . . sequentially shift start signal ST in synchronization with clock signals CLOCK and /CLOCK, and sequentially drive activation enable signals SR1, SR2, SR3, . . . to an "H" level at times T2, T4, T6, . . . , respectively.

Further, before time T5, source IC 18 drives start signal ST to an "H" level again. After time T6, source IC 18 drives start signal ST to an "L" level. Then, shift registers 142.1, 142.2, 142.3, . . . sequentially shift start signal ST in synchronization with clock signals CLOCK and /CLOCK, and sequentially drive activation enable signals SR1, SR2, SR3, . . . to an "H" level at times T6, T8, T10, . . . , respectively.

When activation enable signals SR1 and SR3 simultaneously attain an "H" level and activation enable signals SR2 and SR4 attain an "L" level at time T6, source IC 18 drives enabling signal ENAB for output to vertical scanning circuit 14 to an "H" level. Then, output control circuit 148 drives gate signals G1 and G3 to an "H" level, simultaneously activating gate lines GL1 and GL3. On the other hand, gate lines GL2 and GL4 are not activated. Here, at time T6, 5V, for example, is applied as counter electrode voltage VCOM.

In addition, when activation enable signals SR2 and SR4 simultaneously attain an "H" level and activation enable signals SR1 and SR3 attain an "L" level at time T8, source IC 18 drives enabling signal ENAB to an "H" level. Then, output control circuit 148 drives gate signals G2 and G4 to an "H" level. Therefore, this time, gate lines GL2 and GL4 are simultaneously activated, and gate lines GL1 and GL3 are inactivated. Here, at time T8, counter electrode voltage VCOM is set at 0V, switching the polarity of the display voltages.

It is to be noted that, although not specifically shown, after time T6 and after time T8, source IC 18 outputs enabling signal ENAB at the "H" level, outputs to 1:3 demultiplexer 12 display voltages DATA0-DATAn corresponding to the display in a specific color (for example white or black), and sequentially outputs to 1:3 demultiplexer 12 switching signals RSW, GSW, BSW for subjecting each of display voltages DATA0-DATAn to time division for each pixel.

Thus, with line inversion driving being carried out, the display voltages corresponding to the above-mentioned color display are applied to all the pixels corresponding to gate lines GL1-GL4, constituting the non-display region.

The operation from and after time T22 is basically the same as that from and after time T22 in liquid crystal display apparatus 100 in the first embodiment shown in FIG. 7, except that counter electrode voltage VCOM is switched for each line. Therefore, the description based on the operation waveform from and after time T24 will not be repeated. Thus, the display voltages corresponding to image data are applied to the pixels corresponding to the gate lines from and after gate line GL5, constituting the display region.

In the above description, start signal ST in the partial display mode is driven to the "H" level during times T1-T2 and times T5-T6, and a region corresponding to gate lines GL1-GL4 is accordingly formed as the non-display region. The non-display region can further be enlarged by increasing the number of times to drive start signal ST to the "H" level. For example, the non-display region can be enlarged to a region corresponding to gate lines GL1-GL6 by driving start signal ST to the "H" level also during times T9-T10.

Further, in the above description, the region corresponding to gate lines GL1-GL4 is formed as the non-display region by driving enabling signal ENAB to the "H" level when activation enable signals SR1 and SR3 are simultaneously at the "H" level, and when activation enable signals SR2 and SR4 are simultaneously at the "H" level. The non-display region can be set at another part of liquid crystal display portion 10 by changing the timing to drive enabling signal ENAB to the "H" level.

Furthermore, although not specifically shown, reset signal RESET to reset the internal state of a shift register can also be provided in the third embodiment, as in the second embodiment.

According to the third embodiment providing line inversion driving as described above, a plurality of gate lines can readily be controlled simultaneously, with no addition of a new circuit. Therefore, the partial display mode can be implemented with a simple configuration. Moreover, the ratio between the non-display region and the display region can easily be modified by changing the number of times to activate start signal ST. Further, the position of the non-display region in liquid crystal display portion 10 can be modified arbitrarily by changing the output timing of enabling signal ENAB.

Fourth Embodiment

A fourth embodiment shows a liquid crystal display apparatus having a partial self-refresh function.

Figure 13:
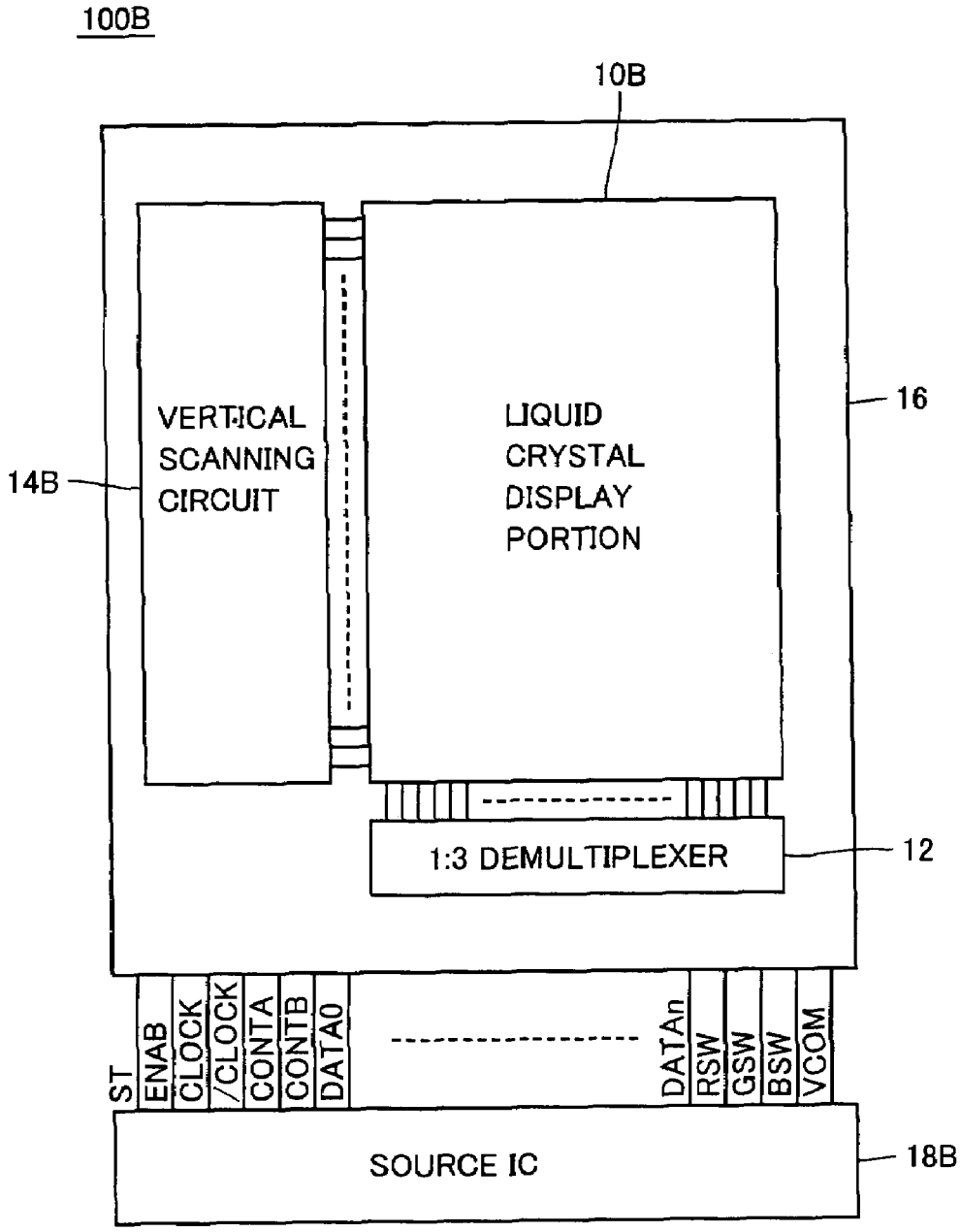
FIG. 13 is a schematic block diagram showing an overall structure of a liquid crystal display apparatus in accordance with a fourth embodiment of the present invention.

FIG. 13 is a schematic block diagram showing an overall structure of a liquid crystal display apparatus 100B in accordance with the fourth embodiment of the present invention. Referring to FIG. 13, liquid crystal display apparatus 100B includes a liquid crystal display portion 10B, a vertical scanning circuit 14B, and a source IC 18B instead of liquid crystal display portion 10, vertical scanning circuit 14, and source IC 18, respectively, in the structure of liquid crystal display apparatus 100 in accordance with the first embodiment shown in FIG. 1.

Liquid crystal display portion 10B includes a plurality of pixels arranged in rows and columns (not shown). Each pixel is provided with a color filter in either one of three primary colors, that is, R (red), G (green), and B (blue). Pixel (R), pixel (G), and pixel (B) adjacent in a column direction form one display unit. Each pixel in liquid crystal display portion 10B carries out a self-refresh operation in response to control signals CONTA and CONTB supplied from source IC 18B. Furthermore, a plurality of gate lines and a plurality of control signal lines for controlling the self-refresh operation in each pixel are arranged corresponding to the rows of the pixels, and a plurality of source lines are arranged corresponding to the columns of the pixels.

Vertical scanning circuit 14B receives start signal ST, enabling signal ENAB, and clock signals CLOCK and /CLOCK from source IC 18B, and activates the plurality of gate lines at predetermined timing in response to these signals. Further, vertical scanning circuit 14B receives control signals CONTA and CONTB from source IC 18B, and activates the plurality of control signal lines at predetermined timing in response to these signals.

Source IC 18B is different from source IC 18 in the first embodiment in that it further outputs control signals CONTA and CONTB to vertical scanning circuit 14B during the self-refresh operation. The structure of source IC 18B is otherwise the same as that of source IC 18.

Figure 14:
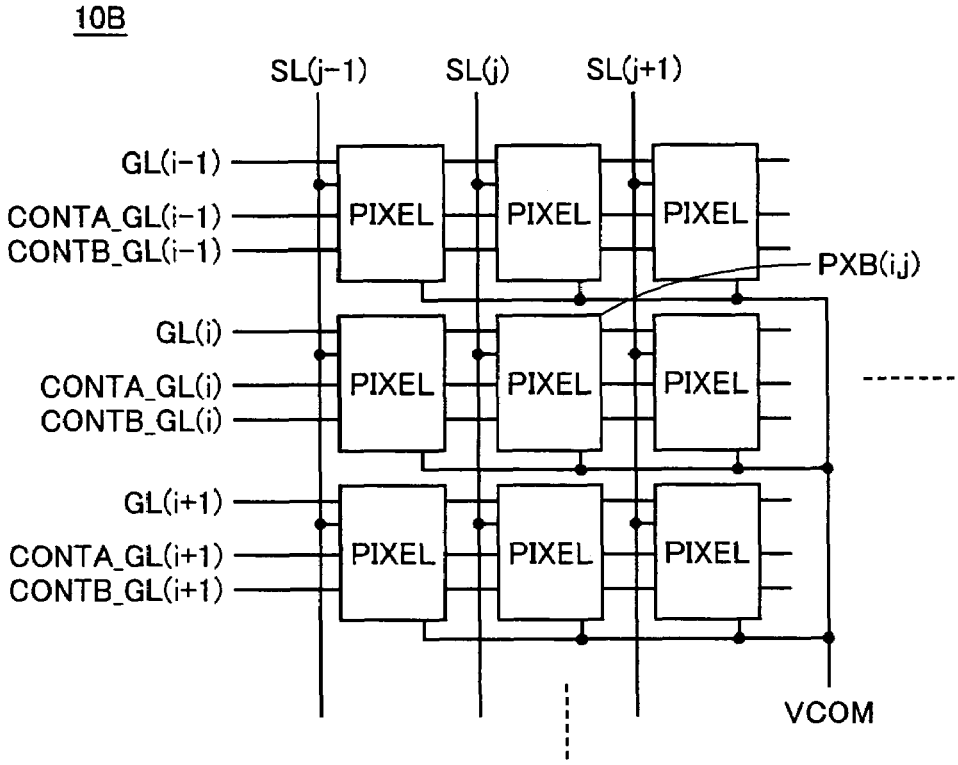
FIG. 14 is a circuit diagram showing a structure of a liquid crystal display portion shown in FIG. 13.

FIG. 14 is a circuit diagram showing a structure of liquid crystal display portion 10B shown in FIG. 13. It is to be noted that, for illustration purpose, FIG. 14 shows only a part of liquid crystal display portion 10B. Referring to FIG. 14, liquid crystal display portion 10B includes a plurality of pixels PXBs arranged in rows and columns, a plurality of gate lines GLs, a plurality of control signal lines CONTA_GLs and CONTB_GLs, and a plurality of source lines SLs.

A pixel PXB(i, j) is connected to a source line SL(j), a gate line GL(i), control signal lines CONTA_GL(i) and CONTB_GL(i), and a voltage line to which counter electrode voltage VCOM is applied. When gate line GL(i) is activated by vertical scanning circuit 14B (not shown) and a display voltage is applied from source line SL(j) to a liquid crystal display element (not shown), the liquid crystal display element can provide display with a luminance in accordance with the display voltage. Although gate line GL(i) is inactivated thereafter, the liquid crystal display element can maintain the luminance (reflectance) in accordance with the applied display voltage, because an internal capacitor (not shown) keeps the potential of a pixel electrode.

Furthermore, pixel PXB(i, j) carries out the self-refresh operation when control signal lines CONTA_GL and CONTB_GL are activated by vertical scanning circuit 14B. More specifically, when control signal line CONTA_GL is activated, pixel PXB(i, j) temporarily saves written data into a predetermined region within pixel PXB(i, j), and when control signal line CONTB_GL is activated, pixel PXB(i, j) carries out rewrite based on the saved data.

Since other pixels PXBs also have the same structure, the description thereof will not be repeated. Further, the plurality of gate lines GLs and the plurality of control signal lines CONTA_GLs and CONTB_GLs constitute "a plurality of pixel control lines".

Figure 15:
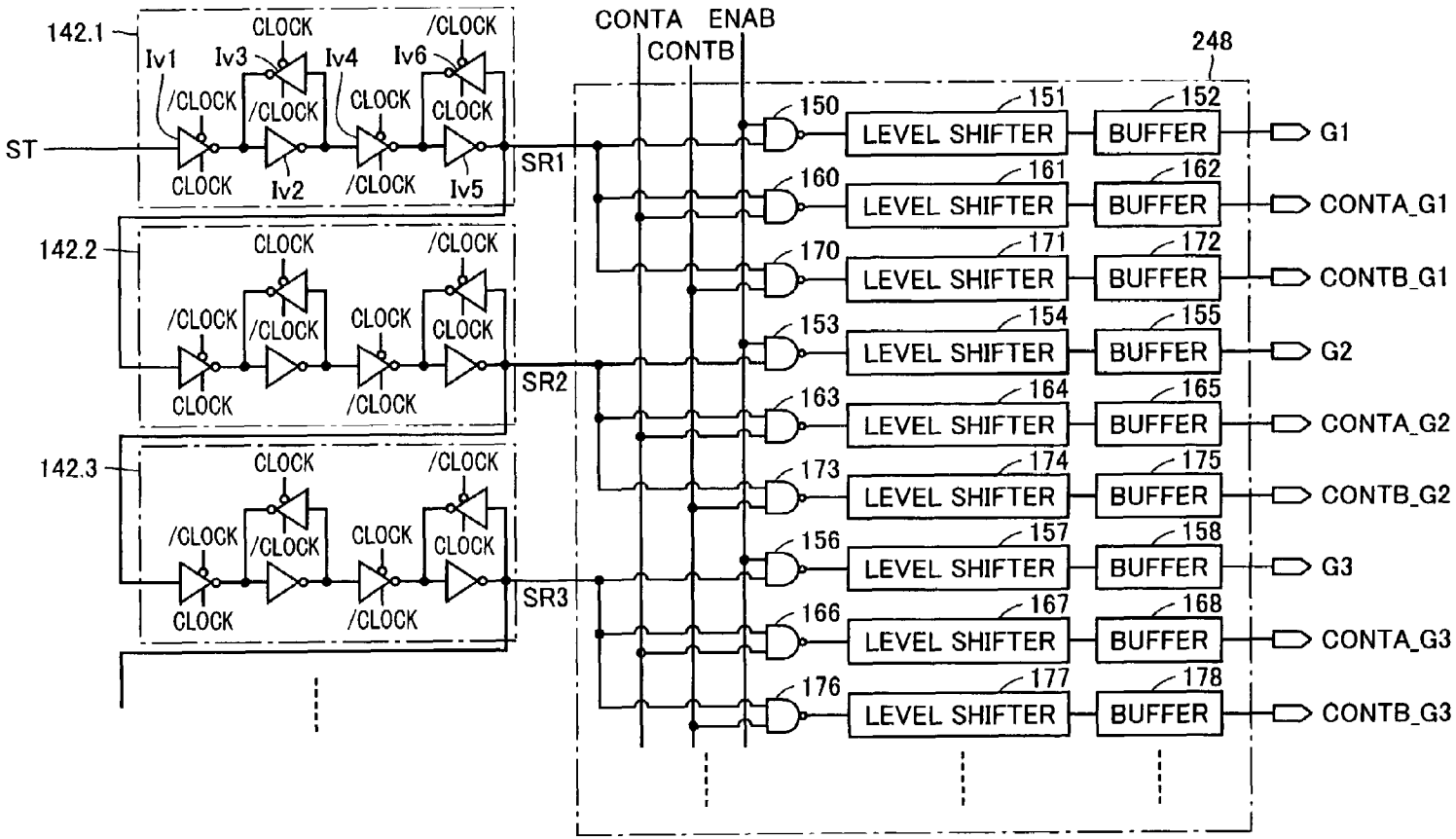
FIG. 15 is a circuit diagram showing a structure of a vertical scanning circuit shown in FIG. 13.

FIG. 15 is a circuit diagram showing a structure of vertical scanning circuit 14B shown in FIG. 13. It is to be noted that, for illustration purpose, FIG. 15 shows only a part of vertical scanning circuit 14B. Referring to FIG. 15, vertical scanning circuit 14B includes an output control circuit 248 instead of output control circuit 148 in the structure of vertical scanning circuit 14 in the first embodiment shown in FIG. 6. In addition to the structure of output control circuit 148, output control circuit 248 further includes NAND gates 160, 163, 166, 170, 173, 176; level shifters 161, 164, 167, 171, 174, 177; and output buffers 162, 165, 168, 172, 175, 178.

NAND gate 160 carries out an AND operation of activation enable signal SR1 output from shift register 142.1 and control signal CONTA output from source IC 18B, and outputs an inverted signal of the operation result to level shifter 161. Then, output buffer 162 outputs the signal supplied from level shifter 161 to a control signal line CONTA_GL1, as a self-refresh control signal CONTA_G1. NAND gate 170 carries out an AND operation of activation enable signal SR1 and control signal CONTB output from source IC 18B, and outputs an inverted signal of the operation result to level shifter 171. Then, output buffer 172 outputs the signal supplied from level shifter 171 to a control signal line CONTB_GL1, as a self-refresh control signal CONTB_G1.

NAND gate 163 carries out an AND operation of activation enable signal SR2 output from shift register 142.2 and control signal CONTA, and outputs an inverted signal of the operation result to level shifter 164. Then, output buffer 165 outputs the signal supplied from level shifter 164 to a control signal line CONTA_GL2, as a self-refresh control signal CONTA_G2. NAND gate 173 carries out an AND operation of activation enable signal SR2 and control signal CONTB, and outputs an inverted signal of the operation result to level shifter 174. Then, output buffer 175 outputs the signal supplied from level shifter 174 to a control signal line CONTB_GL2, as a self-refresh control signal CONTB_G2.

NAND gate 166 carries out an AND operation of activation enable signal SR3 output from shift register 142.3 and control signal CONTA, and outputs an inverted signal of the operation result to level shifter 167. Then, output buffer 168 outputs the signal supplied from level shifter 167 to a control signal line CONTA_GL3, as a self-refresh control signal CONTA_G3. NAND gate 176 carries out an AND operation of activation enable signal SR3 and control signal CONTB, and outputs an inverted signal of the operation result to level shifter 177. Then, output buffer 178 outputs the signal supplied from level shifter 177 to a control signal line CONTB_GL3, as a self-refresh control signal CONTB_G3.

Since the structure of vertical scanning circuit 14B is otherwise the same as that of vertical scanning circuit 14 in the first embodiment shown in FIG. 6, the description thereof will not be repeated.

In vertical scanning circuit 14B, shift registers 142.1, 142.2, 142.3, . . . sequentially shift start signal ST supplied from source IC 18B, in synchronization with the falling timing of clock signal CLOCK. Then, at the timing when enabling signal ENAB supplied from source IC 18B attains an "H" level, output control circuit 248 activates a gate line GL corresponding to an activation enable signal SR which is at an "H" level at that time.

Further, at the timing when control signal CONTA supplied from source IC 18B attains an "H" level, output control circuit 248 activates a control signal line CONTA_GL corresponding to an activation enable signal SR which is at an "H" level at that time. Furthermore, at the timing when control signal CONTB supplied from source IC 18B attains an "H" level, output control circuit 248 activates a control signal line CONTB_GL corresponding to an activation enable signal SR which is at an "H" level at that time.

Normal operation of liquid crystal display apparatus 100B is the same as that of liquid crystal display apparatus 100 in the first embodiment, and operation waveforms of main signals are as those shown in FIG. 8.

Figure 16:
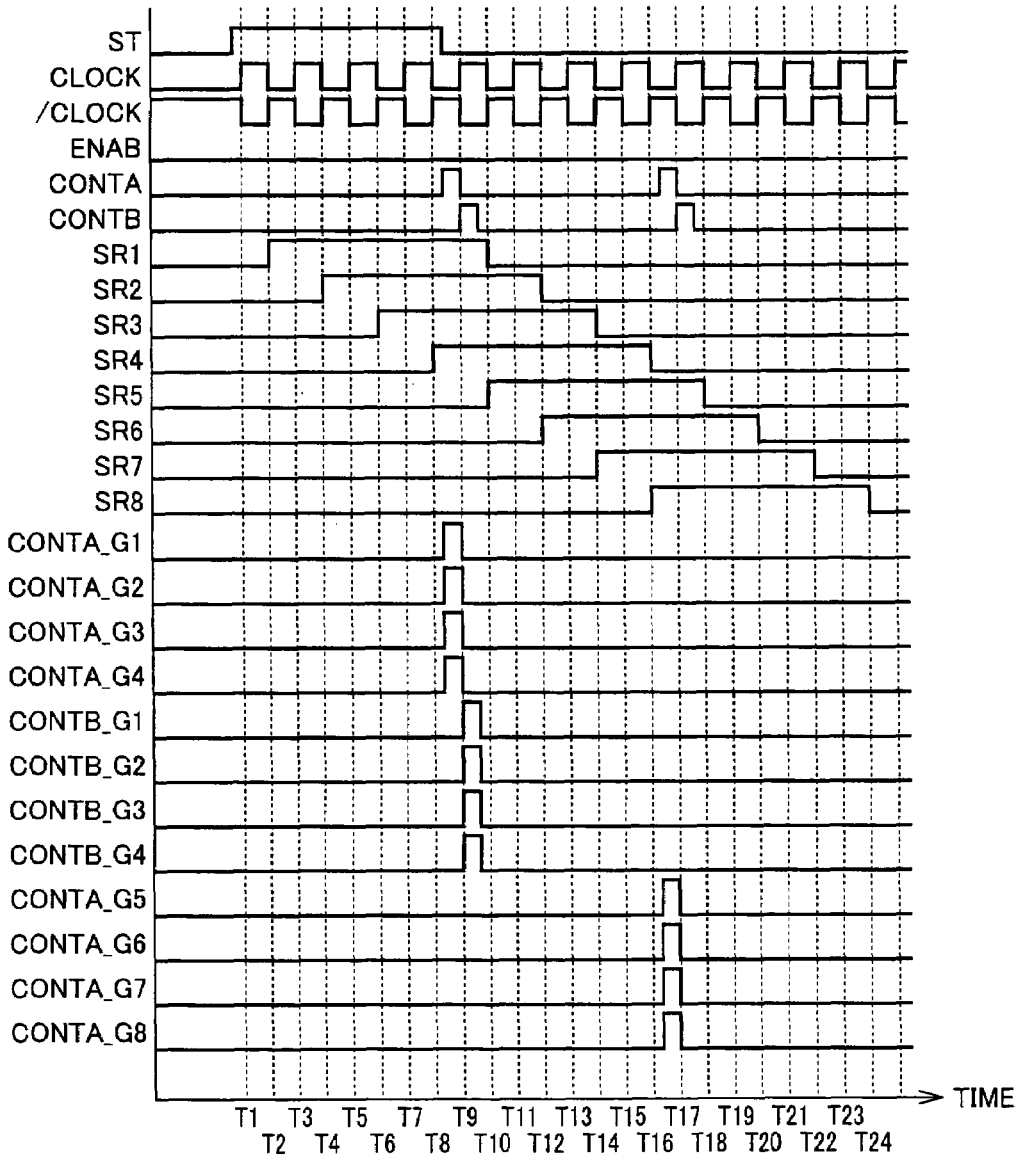
FIG. 16 is an operation waveform diagram of main signals in the liquid crystal display apparatus in accordance with the fourth embodiment, in a self-refresh operation.

FIG. 16 is an operation waveform diagram of main signals in liquid crystal display apparatus 100B in accordance with the fourth embodiment, in the self-refresh operation. Liquid crystal display apparatus 100B in accordance with the fourth embodiment carries out frame inversion driving. Referring to FIG. 16, before time T1, source IC 18B drives start signal ST for output to vertical scanning circuit 14B to an "H" level, and keeps the "H" level until after time T8, over a plurality of cycles. Shift registers 142.1, 142.2, 142.3, . . . sequentially shift start signal ST in synchronization with clock signals CLOCK and /CLOCK, and sequentially drive activation enable signals SR1, SR2, SR3, . . . to an "H" level at times T2, T4, T6, . . . , respectively.

When activation enable signals SR1-SR4 simultaneously attain the "H" level at time T8, source IC 18B drives control signal CONTA for output to vertical scanning circuit 14B to an "H" level. Then, output control circuit 248 of vertical scanning circuit 14B drives refresh control signals CONTA_G1-CONTA_G4 to an "H" level, simultaneously activating control signal lines CONTA_GL1-CONTA_GL4. Thus, the self-refresh operation is initiated at all pixels PXBs in a first block connected to control signal lines CONTA_GL1-CONTA_GL4.

Next, at time T9, source IC 18B drives control signal CONTB to an "H" level. Then, output control circuit 248 drives refresh control signals CONTB_G1-CONTB_G4 to an "H" level, simultaneously activating control signal lines CONTB_GL1-CONTB_GL4. Thus, the pixels in the above first block in which the self-refresh operation has started carry out data rewrite, and complete the self-refresh operation.

Thereafter, when activation enable signals SR5-SR8 simultaneously attain an "H" level at time T16, source IC 18B drives control signal CONTA to an "H" level again. Then, output control circuit 248 drives refresh control signals CONTA_G5-CONTA_G8 to an "H" level, simultaneously activating control signal lines CONTA_GL5-CONTA_GL8. Thus, pixels PXBs in a second block connected to control signal lines CONTA_GL5-CONTA_GL8 simultaneously start the self-refresh operation.

Although not specifically shown, source IC 18B drives control signal CONTB to an "H" level thereafter, and data rewrite is carried out in the above second block.

In this manner, start signal ST has a variable length in liquid crystal display apparatus 100B, and in the self-refresh operation, setting start signal ST at an "H" level over a plurality of cycles of clock signal CLOCK can provide a partial self-refresh operation performed for each block corresponding to that period of time.

In the above description, start signal ST in the self-refresh operation is kept at the "H" level from time T1 to time T8, and the self-refresh operation is accordingly performed for each block corresponding to four lines. The size of the block can be enlarged by further extending the period of time to keep start signal ST at the "H" level, and it can be reduced by shortening the period of time to keep start signal ST at the "H" level.

As described above, according to liquid crystal display apparatus 100B in the fourth embodiment, start signal ST has a variable length, readily allowing for simultaneous control of a plurality of control signal lines controlling the self-refresh operation, with no addition of a new circuit. Therefore, the partial self-refresh operation performing the self-refresh operation for each block can be implemented with a simple structure. Moreover, the size of the block used in the partial self-refresh operation can easily be modified by changing the length of start signal ST, and the size of the block can easily be set according to the capability of a driver in liquid crystal display apparatus 100B.

Fifth Embodiment

A fifth embodiment shows a case where liquid crystal display apparatus 100B in the fourth embodiment carries out line inversion driving.

Since the structure of a liquid crystal display apparatus in the fifth embodiment is the same as that of liquid crystal display apparatus 100B in the fourth embodiment, the description thereof will not be repeated.

Figure 17:
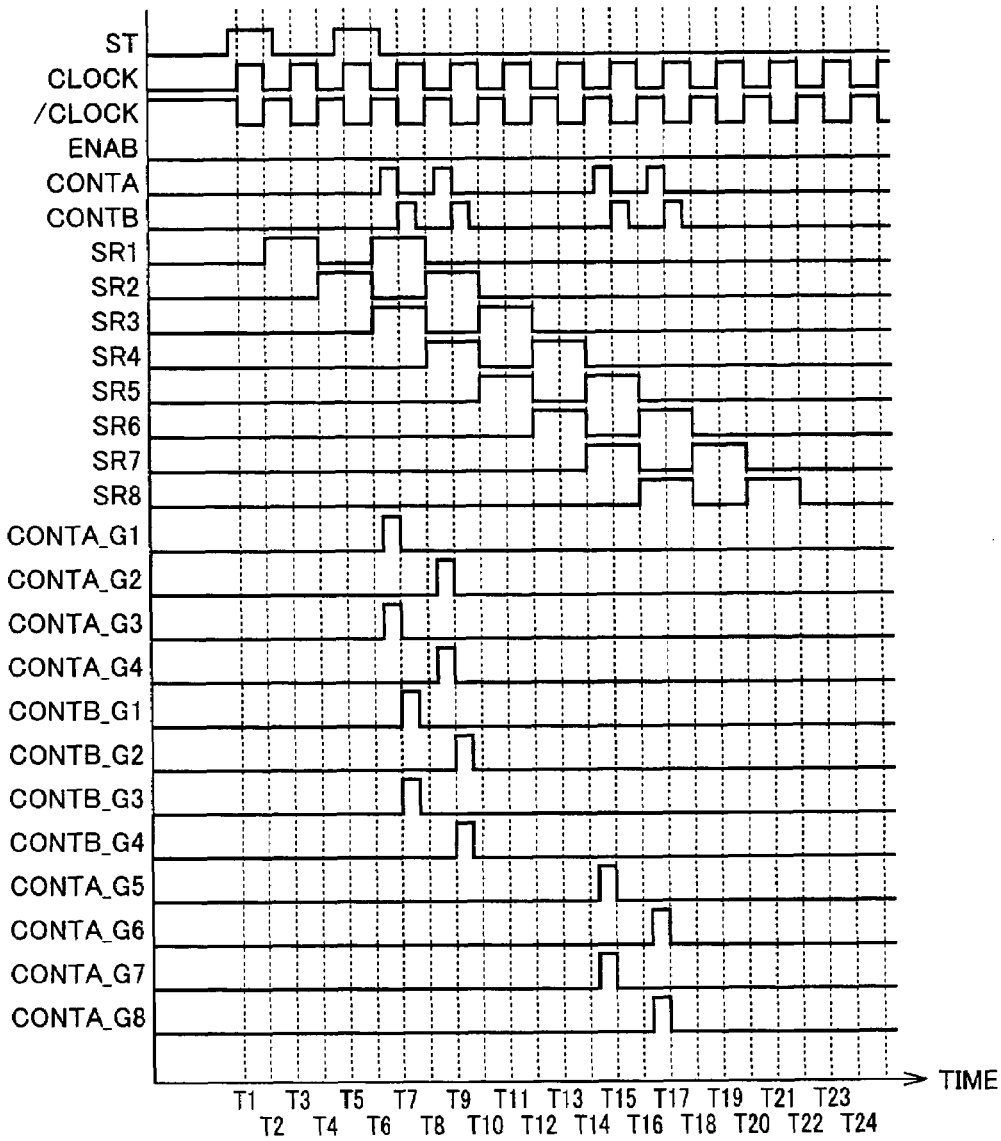
FIG. 17 is an operation waveform diagram of main signals in a liquid crystal display apparatus in accordance with a fifth embodiment, in a self-refresh operation.

FIG. 17 is an operation waveform diagram of main signals in the liquid crystal display apparatus in accordance with the fifth embodiment, in the self-refresh operation. Referring to FIG. 17, before time T1, source IC 18B drives start signal ST for output to vertical scanning circuit 14B to an "H" level. After time T2, source IC 18B drives start signal ST to an "L" level. Then, shift registers 142.1, 142.2, 142.3, . . . sequentially shift start signal ST in synchronization with clock signals CLOCK and /CLOCK, and sequentially drive activation enable signals SR1, SR2, SR3, . . . to an "H" level at times T2, T4, T6, . . . , respectively.

Further, before time T5, source IC 18B drives start signal ST to an "H" level again. After time T6, source IC 18B drives start signal ST to an "L" level. Then, shift registers 142.1, 142.2, 142.3, . . . sequentially shift start signal ST in synchronization with clock signals CLOCK and /CLOCK, and sequentially drive activation enable signals SR1, SR2, SR3, . . . to an "H" level at times T6, T8, T10, . . . , respectively.

When activation enable signals SR1 and SR3 simultaneously attain an "H" level and activation enable signals SR2 and SR4 attain an "L" level at time T6, source IC 18B first drives control signal CONTA to an "H" level. Then, output control circuit 248 drives control signals CONTA_G1 and CONTA_G3 to an "H" level, simultaneously activating control signal lines CONTA_GL1 and CONTA_GL3.

Next, at time T7, source IC 18B drives control signal CONTB to an "H" level. Then, output control circuit 248 drives control signals CONTB_G1 and CONTB_G3 to an "H" level, simultaneously activating control signal lines CONTB_GL1 and CONTB_GL3. That is, during times T6-T8, the self-refresh operation is simultaneously carried out at the pixels connected to control signal lines CONTA_GL1 and CONTA_GL3 (control signal lines CONTB_GL1 and CONTB_GL3).

On the other hand, during this period, control signal lines CONTA_GL2, CONTB_GL2, CONTA_GL4, and CONTB_GL4 are not activated. It is to be noted that, although not shown, at time T6, 5V, for example, is applied as counter electrode voltage VCOM.

Next, when activation enable signals SR2 and SR4 simultaneously attain an "H" level and activation enable signals SR1 and SR3 attain an "L" level at time T8, source IC 18B drives control signal CONTA to an "H" level again. This time, output control circuit 248 drives control signals CONTA_G2 and CONTA_G4 to an "H" level, simultaneously activating control signal lines CONTA_GL2 and CONTA_GL4.

Subsequently, at time T9, source IC 18B drives control signal CONTB to an "H" level. Then, output control circuit 248 drives control signals CONTB_G2 and CONTB_G4 to an "H" level, simultaneously activating control signal lines CONTB_GL2 and CONTB_GL4. That is, during times T8-T10, the self-refresh operation is simultaneously carried out at the pixels connected to control signal lines CONTA_GL2 and CONTA_GL4 (control signal lines CONTB_GL2 and CONTB_GL4). It is to be noted that, although not shown, counter electrode voltage VCOM is set at 0V at time T8, switching the polarity of the display voltages.

When activation enable signals SR5 and SR7 simultaneously attain an "H" level and activation enable signals SR6 and SR8 attain an "L" level at time T14, source IC 18B drives control signal CONTA to an "H" level. Then, output control circuit 248 drives control signals CONTA_G5 and CONTA_G7 to an "H" level, simultaneously activating control signal lines CONTA_GL5 and CONTA_GL7.

Subsequently, at time T15, source IC 18B drives control signal CONTB to an "H" level. Then, output control circuit 248 drives control signals CONTB_G5 and CONTB_G7 to an "H" level, simultaneously activating control signal lines CONTB_GL5 and CONTB_GL7 (not shown). That is, during times T14-T16, the self-refresh operation is simultaneously carried out at the pixels connected to control signal lines CONTA_GL5 and CONTA_GL7 (control signal lines CONTB_GL5 and CONTB_GL7). On the other hand, during this period, control signal lines CONTA_GL6, CONTB_GL6, CONTA_GL8, and CONTB_GL8 are not activated.

Next, when activation enable signals SR6 and SR8 simultaneously attain an "H" level and activation enable signals SR5 and SR7 attain an "L" level at time T16, source IC 18B drives control signal CONTA to an "H" level again. This time, output control circuit 248 drives control signals CONTA_G6 and CONTA_G8 to an "H" level, simultaneously activating control signal lines CONTA_GL6 and CONTA_GL8.

Subsequently, at time T17, source IC 18B drives control signal CONTB to an "H" level. Then, output control circuit 248 drives control signals CONTB_G6 and CONTB_G8 to an "H" level, simultaneously activating control signal lines CONTB_GL6 and CONTB_GL8 (not shown). That is, during times T16-T18, the self-refresh operation is simultaneously carried out at the pixels connected to control signal lines CONTA_GL6 and CONTA_GL8 (control signal lines CONTB_GL6 and CONTB_GL8).

As described above, the fifth embodiment carrying out line inversion driving can also provide the effects similar to those obtained by the fourth embodiment carrying out frame inversion driving.

It is to be noted that, although each of the above embodiments has described a case utilizing frame inversion driving or line inversion driving, the applicable range of the present invention is not limited to these inversion driving methods. The present invention can also be applied to other driving methods, such as the one carrying out data writing every other multiple lines.

Further, although each of the above embodiments has described a case utilizing a liquid crystal display apparatus as an example of the image display apparatus in accordance with the present invention, the applicable range of the present invention is not limited to the liquid crystal display apparatus. The present invention can also be applied to an electroluminescent display apparatus changing the current supplied to an organic light emitting diode, which is a current driven light emitting element provided for each pixel, to change the display luminance of the organic light emitting diode.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image display apparatus, comprising:

an image display portion including a plurality of image display elements arranged in rows and columns;

a plurality of pixel control lines arranged corresponding to the rows of said plurality of image display elements;

a vertical scanning circuit connected to said plurality of pixel control lines; and a control device generating a scanning start signal for designating start of vertical scanning and an enabling signal for designating activation of a pixel control line of activation target, and outputting each of the generated signals to said vertical scanning circuit, in a partial display mode partially displaying an image on said image display portion, or in a partial self-refresh operation dividing a self-refresh operation for saving and rewriting data in said plurality of image display elements into a plurality of blocks and performing the self-refresh operation for each block in said image display portion, said vertical scanning circuit simultaneously placing multiple pixel control lines corresponding in number to an activation period of said scanning start signal at an activation enable state, and simultaneously activating the multiple pixel control lines in said activation enable state in response to activation of said enabling signal, with a region corresponding to the multiple pixel control lines in said activation enable state as a non-display region or a refresh region.

2. The image display apparatus according to claim 1, wherein said vertical scanning circuit includes:

a plurality of shift registers provided corresponding to said plurality of pixel control lines and connected in series along a scanning direction, and an output control circuit activating a pixel control line in said activation enable state corresponding to a shift register having an output activated when said enabling signal is activated, and said plurality of shift registers receive said scanning start signal at a shift register in a first stage, and sequentially shift said scanning start signal to a shift register in a succeeding stage in synchronization with a clock signal.

3. The image display apparatus according to claim 2, wherein in a normal operation, said control device activates said scanning start signal for only one cycle of said clock signal and activates said enabling signal in synchronization with said clock signal, and in said partial display mode, said control device activates said scanning start signal for a plurality of cycles of said clock signal within a frame of the image to be displayed on said image display portion, and activates said enabling signal at a timing of simultaneous activation of outputs of shift registers corresponding to said non-display region.

4. The image display apparatus according to claim 3, wherein said image display portion is subject to frame inversion driving, and said control device activates said scanning start signal for a plurality of consecutive cycles of said clock signal in said partial display mode.

5. The image display apparatus according to claim 3, wherein said control device further outputs a reset signal for resetting an internal state of each of said plurality of shift registers, and activates said reset signal after activation of said enabling signal in said partial display mode, and each of said plurality of shift registers resets the internal state in response to activation of said reset signal.

6. The image display apparatus according to claim 3, wherein said image display portion is subject to line inversion driving, and said control device alternately repeats activation and inactivation of said scanning start signal for a plurality of times in synchronization with said clock signal in said partial display mode.

7. The image display apparatus according to claim 2, wherein each of said plurality of pixel control lines includes a control signal line for designating said self-refresh operation at a corresponding image display element, in a normal operation, said control device activates said scanning start signal for only one cycle of said clock signal and activates said enabling signal in synchronization with said clock signal, and in said partial self-refresh operation, said control device activates said scanning start signal for a plurality of cycles of said clock signal within a frame of the image to be displayed on said image display portion, and activates said enabling signal at a timing of simultaneous activation of outputs of shift registers corresponding to said refresh region.

8. The image display apparatus according to claim 7, wherein said image display portion is subject to frame inversion driving, and said control device activates said scanning start signal for a plurality of consecutive cycles of said clock signal in said partial self-refresh operation.

9. The image display apparatus according to claim 7, wherein said image display portion is subject to line inversion driving, and said control device alternately repeats activation and inactivation of said scanning start signal for a plurality of times in synchronization with said clock signal in said partial self-refresh operation.

* * * * *